US009999891B2

(12) United States Patent
Lefas et al.

(10) Patent No.: US 9,999,891 B2
(45) Date of Patent: Jun. 19, 2018

(54) AIR COOLED ROTATING DISC AND MILL ASSEMBLY FOR REDUCING MACHINES

(71) Applicants: Hristos Lefas, Toronto (CA); Friedhelm Roderich Feder, Colmesneil, TX (US)

(72) Inventors: Hristos Lefas, Toronto (CA); Friedhelm Roderich Feder, Colmesneil, TX (US)

(73) Assignee: ORENDA AUTOMATION TECHNOLOGIES INC., Markham, Ontario (CA)

( * ) Notice: Subject to any disclaimer, the term of this patent is extended or adjusted under 35 U.S.C. 154(b) by 561 days.

(21) Appl. No.: 14/323,273

(22) Filed: Jul. 3, 2014

(65) Prior Publication Data

US 2015/0076262 A1 Mar. 19, 2015

Related U.S. Application Data

(63) Continuation-in-part of application No. 13/742,773, filed on Jan. 16, 2013, now Pat. No. 9,468,929.

(51) Int. Cl.
*B02C 7/17* (2006.01)
*B02C 7/02* (2006.01)
(Continued)

(52) U.S. Cl.
CPC ..... *B02C 7/17* (2013.01); *B02C 7/02* (2013.01); *B02C 7/08* (2013.01); *D21D 1/303* (2013.01)

(58) Field of Classification Search
CPC .... B02C 7/17; B02C 7/08; B02C 7/02; D21D 1/303
(Continued)

(56) References Cited

U.S. PATENT DOCUMENTS 3,926,380 A 12/1975 Musgrove et al.
4,081,147 A 3/1978 Seifert et al.
(Continued)

FOREIGN PATENT DOCUMENTS

BE 373524 9/1930
BE 373 524 A 10/1930
(Continued)

OTHER PUBLICATIONS

European Examiner's Report and Supplemental Search Report dated Aug. 25, 2016 issued in related European application No. 14 740 327.3.

(Continued)

*Primary Examiner* — Faye Francis

(57) ABSTRACT

A reducing machine having an air cooled cutting discs is disclosed. The air cooled discs have cutting surfaces on both sides. The cutting surfaces have edges which are sharpened for cutting input material when the cutting surface is facing the cutting surface of the opposed disc. When the cutting surface of the stationary disc is facing the housing, the cutting surface acts as a heat sink to air cool the stationary disc and the mill assembly in general. Air inlets in the housing lid permit air to flow over the cooling surface of the stationary plate. Air inlets in the carrying plate permit the carrying plate to channel air flow over the rotating cooling surface. A damper restricts air flow over the air cooling surfaces to control the temperature of the reducing machine, such as during start up.

20 Claims, 22 Drawing Sheets

(51) Int. Cl.
*B02C 7/08* (2006.01)
*D21D 1/30* (2006.01)

(58) Field of Classification Search
USPC ..... 241/261.2, 261.3, 65, 66, 67
See application file for complete search history.

(56) References Cited

U.S. PATENT DOCUMENTS

| | | | | |
|---|---|---|---|---|
| 5,941,467 | A | 8/1999 | McArdle et al. | 241/5 |
| 8,282,031 | B2 | 10/2012 | Sly et al. | |
| 2006/0086856 | A1* | 4/2006 | Pallmann | B02C 7/17 241/261.2 |
| 2011/0318440 | A1 | 12/2011 | Zollitsch et al. | 425/67 |

FOREIGN PATENT DOCUMENTS

| | | | | |
|---|---|---|---|---|
| EP | 1 028 808 | B1 | 11/2006 | B02C 1/100 |
| EP | 2 399 716 | A2 | 12/2011 | B29B 9/06 |
| FR | 417 479 | A | 11/1910 | |
| FR | 417479 | | 11/1910 | |
| FR | 869 144 | A | 2/1945 | |
| FR | 896144 | | 2/1945 | |
| GB | 467196 | | 6/1937 | |
| JP | H05345131 | | 12/1993 | |
| WO | WO 99/12647 | A2 | 3/1999 | |
| WO | WO 2011/106115 | A2 | 9/2011 | B02C 7/02 |

OTHER PUBLICATIONS

"Stationary Disc, Rotating Disc and Mill Assembly for Reducing Machines" Specification, Drawings, Claims and Prosecution History, of U.S. Appl. No. 13/742,773, filed Jan. 16, 2013, by Hristos Lefas, et al., which is stored in the United States Patent and Trademark Office (USPTO) Image File Wrapper (IFW) system.

"Stationary Disc, Rotating Disc and Mill Assembly for Reducing Machines" Specification, Drawings, Claims and Prosecution History, of U.S. Appl. No. 15/283,369, filed Oct. 1, 2016, by Hristos Lefas, et al., which is stored in the United States Patent and Trademark Office (USPTO) Image File Wrapper (IFW) system.

Australian Office Action dated Jun. 21, 2017 issued in corresponding Australian Application No. 2014207206.

Extended European Search Report dated Jan. 31, 2018, issued in corresponding European Application No. 14896324.2.

Chinese Office Action dated Mar. 26, 2018 issued in the corresponding Chinese Application No. 201480080000.5.

* cited by examiner

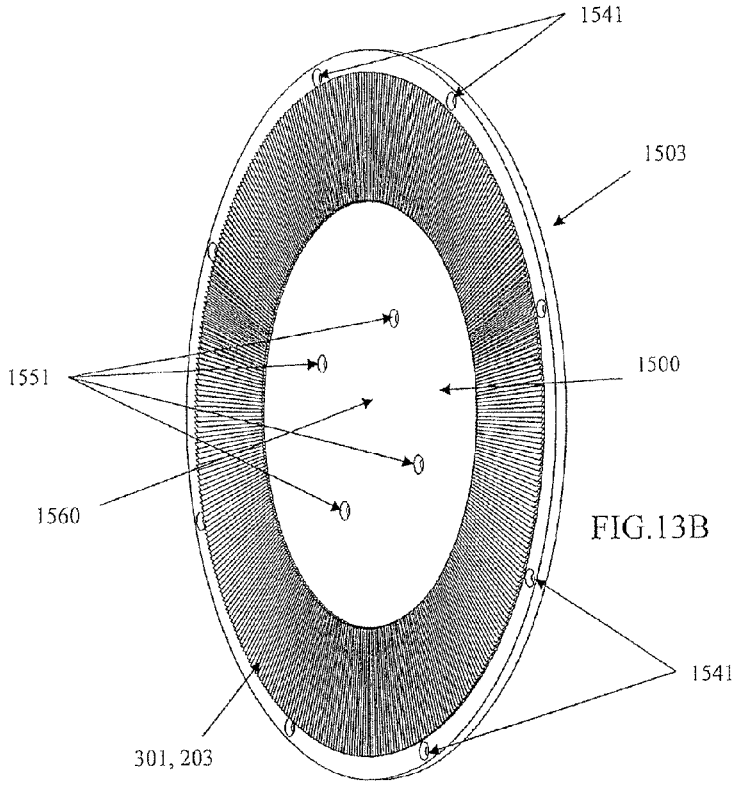
FIG.13B
FIG.13A
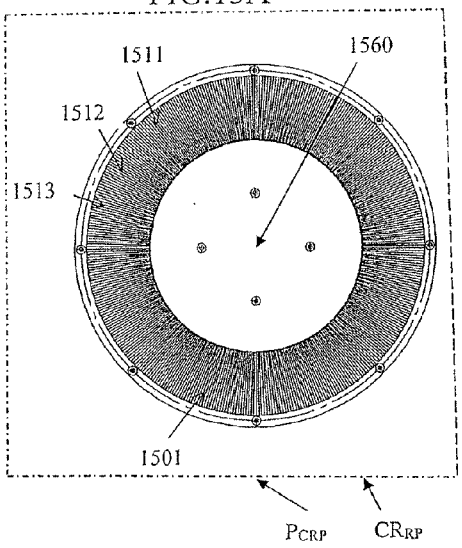
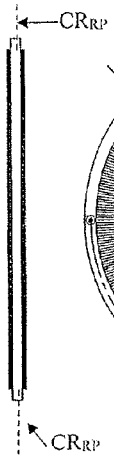
FIG.13D
FIG.13C
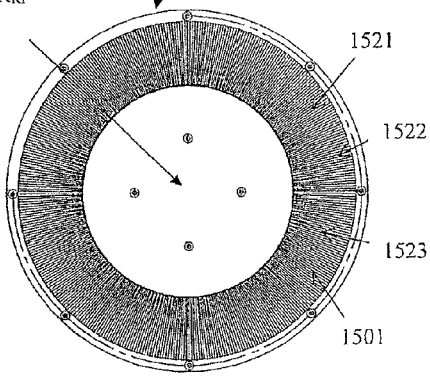

AIR COOLED ROTATING DISC AND MILL ASSEMBLY FOR REDUCING MACHINES

CROSS-REFERENCE TO RELATED APPLICATION

The present application is a continuation-in-part of, and claims the benefit under any applicable U.S. statute to, U.S. patent application Ser. No. 13/742,773 filed Jan. 16 2013, titled Stationary Disc, Rotating Disc and Mill Assembly For Reducing Machines.

This application incorporates by reference U.S. application Ser. No. 13/742,773, as if fully set forth herein.

FIELD OF THE INVENTION

The invention relates to the field of reducing machines and in particular pulverizing machines. More particularly, the present invention relates to rotating discs and disc mill assemblies for use in such machines.

BACKGROUND OF THE INVENTION

In the past, reducing machines, including pulverizing systems, have used disc mill assemblies to grind, shred or pulverize various types of materials such as plastics, nylons, polyesters and other polymers into powder, amongst other industrial applications. Typically, reducing machines have cooperating cutting discs having opposed cutting surfaces. Typically, one cutting disc is stationary, often referred to as the stationary disc, and one cutting disc is rotating, often referred to as the rotating disc. Input material to be reduced passes between the cutting surfaces of the discs radially from the centre to the circumference by virtue of centrifugal force, often assisted by a vacuum created by a fan forming a part of the reducing machine.

A major problem with reducing machines in general is the management of heat. As the input material is ground, shredded or pulverized by the relative rotation of the cutting discs, heat is generated and must be dissipated to avoid damage to the discs as well as potentially melting or degrading of the input materials. To facilitate cooling of the disc assembly, prior art reducing machines have generally utilized a water cooling system, including a water jacket assembly, for cooling the stationary disc as disclosed for instance in U.S. Pat. No. 8,282,031 B2 to Sly. The water jacket cooling assembly would permit water, or another liquid, to be circulated on the non-cutting surface of the stationary reducing disc to dissipate heat generated by the cutting surfaces of the disc assembly, and in particular the stationary disc when it is in facing operative relation the rotating disc arranged.

However, water jacket assemblies can be rather expensive to design, build and maintain, thereby increasing the cost of the overall machine. Also, water jackets leak regularly thereby causing rusting of the disc assembly, and/or contaminate the input material being reduced.

A further difficulty with water cooling of the stationary disc is that, invariably, the temperature of the stationary disc near the water inlet will be lower than the temperature of the stationary disc at a location remote from the water inlet due to the fact that the water will absorb heat while it is circulating and in thermal contact with the stationary disc. This can cause temperature variations and thermal imbalances in the stationary disc which can cause structural stress.

Furthermore, if the operators of the reducing machines are not careful and turn on the water cooling system when the stationary disc has been operating for some time and is at an elevated temperature, the stationary disc could experience "thermal shock" from a sudden temperature decrease. This often results in damage to the stationary disc and, in some cases, a catastrophic failure of the stationary disc.

Furthermore, because of the risk of "thermal shock" and other damage that could be caused by water cooling, the material used for the cutting discs, and in particular the stationary disc, would need to be selected such as to decrease the possibility of such "thermal shock" for safety purposes. In particular, the material of the stationary disc would need to be of a softer material to decrease the possibility of cracking.

A further disadvantage of the prior reducing machines is that considerable time is required in which to initially heat up the reducing machine prior to use. Typically, the reduced material generated while the reducing machine is warming up, is often called "off-spec" or "off specification" reduced material, and is usually discarded or blended back with the input material for further processing. At present, many prior art reducing machines are run with material for about 20 to 30 minutes in order to heat the reducing machine prior to producing useful reduced material. During the initial heating process, raw material is inserted into the machine and then the resulting off-spec material is discarded. Throughout the initial heating process, the stationary disc must be continuously cooled using the water cooling system, otherwise thermal shock could arise if the water cooling is suddenly commenced after the reducing machine, including the stationary disc, has been heated to an operating temperature. Because of this, the water cooling acts against the initial heating of the reducing machine thereby lengthening the amount of time required in order to heat the reducing machine to a useable temperature and generating additional off-spec material that is generally discarded or blended back with the input material. This also increases the wear and tear of the mill assembly as a whole because it must be operated for a longer period of time to heat the reducing machine.

Another disadvantage with prior art discs, and in particular rotating discs, is that cracks may develop, which could eventually lead to a failure, and eventually a catastrophic failure. While cracks may appear in both the stationary disc and the rotating disc, crack development and propagation are more common with rotating discs because of the increased stress caused by the rotation. Cracks can develop particularly near openings or orifices because of increased localized stress levels. Therefore, for safety concerns, it is important to decrease crack generation and propagation, particularly near openings or orifices in the rotating disc.

In addition, while rotating discs are cooled as a result of their rotation, this air cooling is often inefficient. This is the case, in part, because the rotating disc is often contained within a structural member, such as a carrying plate, which inherently insulates the rotating disc. In other cases, even if the rotating disc may be exposed to the air, the air is not efficiently channelled over the rotating disc. Furthermore, prior art devices may recirculate heated air within the disc chamber, decreasing cooling efficiency.

Furthermore, heat generation is a limiting factor of most reducing machines. Increased heat generation limits productivity and, conversely, increased heat dissipation increases productivity. Furthermore, increased heat generation limits the types of material which can be reduced.

Accordingly, the prior art reducing machines suffer from several disadvantages related to the manner in which the mill assembly, and in particular the stationary and rotating discs, are cooled. Furthermore, the method of cooling of the mill assembly, and in particular the stationary disc according to the prior art assembly, increases the cost of manufacture, assembly and operation and also restricts the nature of the material used for the discs.

SUMMARY OF THE INVENTION

Accordingly, it is an object of this invention to at least partially overcome some of the disadvantages of the prior art. In particular, an object of the invention to provide an improved type of rotating disc and stationary disc for use in mill assembly for a reducing machine, and in particular a pulverizing machine, with improved heat management.

Accordingly, in one of its aspects, the present invention resides in a disc mill assembly of a reducing apparatus, said disc mill assembly comprising: a stationary disc having a stationary cutting surface; a rotating disc having a rotating cutting surface on a first side for operative interaction with the stationary cutting surface of the opposed stationary disc, and, a second side having a rotating air cooling surface in thermal contact with the rotating cutting surface; a carrying plate having air inlets; an attaching mechanism for operatively attaching the rotating disc to the carrying plate with the rotating air cooling surface facing the air inlets and axially separated therefrom to permit air flow between said carrying plate and the rotating air cooling surface; wherein, during operation, the carrying plate and rotating disc rotate, and, air enters through the air inlets and passes between the carrying plate and the rotating air cooling surface, to cool the rotating disc.

In a further aspect, the present invention resides in a rotating disc for use in a disc mill assembly of a reducing machine, said rotating disc comprising: an annular rotating cutting surface for operative interaction with cutting surfaces of an opposed stationary disc; a solid centre support portion extending radially inwardly from the annular rotating cutting surface for supporting the annular rotating cutting surface; an attaching mechanism for attaching the rotating disc to a carrying plate, said attaching mechanism comprising an inner attaching mechanism located radially within the annular rotating cutting surface.

In a still further aspect, the present invention provides a carrying plate for carrying a rotating disc in a disc mill assembly, said rotating disc having a first side comprising a rotating cutting surface for operative interaction with a stationary cutting surface of an opposed stationary disc, and, a second side having a rotating air cooling surface in thermal contact with the rotating cutting surface, the carrying plate comprising: air inlets permitting air flow therethrough; an attaching mechanism for operatively attaching the rotating disc to the carrying plate with the rotating air cooling surface facing the air inlets and axially separated therefrom to permit air flow between the carrying plate and the rotating air cooling surface; wherein, during operation, the carrying plate and the rotating disc rotate, and air enters through the air inlets passes between the carrying plate and the rotating air cooling surface, to cool the rotating disc.

Accordingly, one advantage of the present invention is that the stationary disc is air cooled rather than water cooled. In this way, the risk of thermal shock is eliminated as air cooling is a less aggressive form of cooling than water cooling. Also, air cooling according to the present invention utilizes the vacuum created by a fan, or the fan of the reducing machine itself such that it is inherently active at all times that the machine is active. In this way, sudden temperature differences are avoided because air cooling is active whenever the fan is active. Furthermore, air cooling provides more uniform heat transfer rates over time and also over the surface of the stationary disc.

A further advantage of the present invention is that the rotating disc is air cooled directly, rather than indirectly, such as by air cooling the carrying plate or other structural elements. Moreover, the air is channelled across a rotating cooling surface on the opposite side of the rotating disc from the rotating cutting surface. This is accomplished, in one preferred embodiment, by having the rotating air cooling surface facing the air inlets in the carrying plate and axially separated therefrom. This increases the air flow near the rotating cooling surface during rotation of the rotating disc and carrying plate. In a further preferred embodiment, air passages are formed by backward curved support ribs at a location radially past the rotating air cooling surface to channel the air as the rotating disc and carrying plate rotate.

Furthermore, air cooling involves fewer component parts and, in particular, separate chilling and pumping units common with water cooling are not required. Rather, in a preferred embodiment, the vacuum generated by the fan of the reducing machine is used to cause airflow across the cooling surface of the stationary disc, and/or rotating disc thereby decreasing the costs of the overall machine and also the operation. Furthermore, because there is no water jacket and no corresponding connections to the water jacket that must be removed when the stationary disc is replaced, the replacement of this stationary disc becomes easier and less time consuming.

A further advantage of the present invention is that because thermal shock is of lessened concern, the material used for the discs in the mill assembly, and in particular the stationary disc, can be changed to improve performance and durability as safety concerns due to cracking are lessened. In particular, a harder material can be used, particularly for the stationary disc.

A further advantage of the present invention is that the stationary disc no longer needs to have a flat surface in contact with the water jacket for cooling. Rather, it is preferable if the cooling surface is ribbed or has fins to promote air cooling. Because of this, the shape of the side of the disc which is not operatively facing the rotating disc can be changed and need not be flat. In one preferred embodiment, the cooling surface comprises a plurality of radial ridges which are also sharpened and can act as a second cutting surface when the first cutting surface becomes dull. In this way, the stationary disc can have two operational cutting surfaces for use at different times. In this way, the ridges of the cutting surfaces can perform the dual purpose of acting as a heat sink, when they are facing the air inlets for the housing and not facing the cutting surface of the rotating disc, and, can act as a cutting surface when facing the cutting surface of the rotating disc.

A further advantage of the present invention is that the rotating disc can also be made to have rotating cutting surfaces on either side similar to the preferred embodiment of the stationary disc. In this way, the rotating disc and the stationary disc can effectively double the service life of the discs used in the disc mill assembly as compared to discs having cutting surfaces on only a single side of the stationary disc and rotating disc. In addition, in the embodiment where the rotating disc has a radial flange for attaching radially to a carrying plate, the rotating disc and stationary disc can be substantially identical, decreasing manufacturing, storage and shipping costs.

A further advantage, in another embodiment, is that the rotating disc can be made of a substantially continuous solid disc and without a center orifice. This can decrease structural stresses on the rotating disc by eliminating the center orifice and the resulting stresses. Rather, having a central support portion creating a substantially continuously rotating disc can decrease cracking and failure of the rotating disc. Furthermore, the central portion can have a thickness which is less than the thickness along the cutting surface to decrease weight, the cost of manufacture and the associated shipping cost.

In a further preferred embodiment, the stationary disc and rotating disc are designed not to be resharpened. In this way, once the rotating disc and the stationary disc are used until the cutting surfaces on both sides are dull, they can be discarded. In this way, lighter material can be used for the stationary disc and rotating disc which also facilitates cooling of the stationary disc and rotating disc. Furthermore, using a lighter material decreases transportation costs and manufacturing cost of both the stationary disc and rotating disc. By effectively doubling the service life of each disc, there are financial and logistical benefits which arise from one disc being shipped and purchased, but used effectively two times.

Furthermore, because the weight of the rotating disc is considerably less, the centrifugal force that is generated by it also decreases, resulting in less stress on the disc and the wear and tear on the rotating disc assembly.

A further advantage of the present invention is that because the rotating disc has cutting surfaces on both sides, the rotating disc can be substantially symmetrical about the radial axis and the plane of rotation, whether or not the rotating disc has an orifice or supporting portion in the center. In this way, the rotating disc can be symmetric about the radial plane such that the centre of mass will lay on the axis or rotation. This decreases flexing of the rotating disc in either direction while it is rotating. Furthermore, the stationary disc is also preferably a symmetrical about the radial axis which facilitates the manufacturing process.

A further advantage of the present invention is that there are no cooling liquids such as water used within the reducing machine. In this way, the risk of contamination, as well as rusting, which have occurred with water leaking in the prior art water cooling systems, is avoided. The only components used in the cooling of the stationary disc according to preferred embodiments of the present invention is air, preferably drawn in through the same negative pressure caused by a fan or, in a preferred embodiment, the fan of the reducing machine itself.

A further advantage of the present invention is that the reducing machine can be initially heated to a useable temperature much more quickly. This is the case, at least because the air cooling of the stationary disc is less aggressive and does not interfere with the initial heating of the overall system. Thus, initial heating time can be reduced and the amount of off-spec material produced during the initial heating time can be lessened. Furthermore, the wear and tear on the entire reducing machine, including the rotating and stationary disc, is lessened because less material must be inputted during the initial heating stage.

A further advantage of the embodiment of the invention is that air flow over the stationary disc can be controlled to better manage the temperature of the reducing machine as a whole. This is particularly useful at the initial heating stage where heat is preferably retained in the system.

A further advantage of this embodiment of the invention is that air flow over the rotating disc can also be controlled to better manage the temperature of the reducing machine. Moreover, the air flow over the stationary disc and rotating disc can be independently controlled to better manage the temperature of each disc and the machine as a whole.

A further advantage of the present invention is that the design of the disc mill assembly permits cooler air to enter the disc chamber and also decreases recycling of hot air in the disc chamber. This facilitates cooling of the pulverized material exiting from between the discs and the disc assembly as a whole. In this way, pulverized material is less likely to agglomerate. Thus, a wider range of materials may be pulverized, such as nylon and polypropylene, which could melt after pulverizing and agglomerate into large masses if not kept below their melting temperature after pulverizing.

Further aspects of the invention will become apparent upon reading the following detailed description and drawings, which illustrate the invention and preferred embodiments of the invention.

BRIEF DESCRIPTION OF THE DRAWINGS

In the drawings, which illustrate embodiments of the invention:

FIGS. 13A, 13B, 13C, 13D and 13E illustrate the continuous rotating disc according to one preferred embodiment in the present invention;

DETAILED DESCRIPTION OF THE PREFERRED EMBODIMENTS

Preferred embodiments of the invention and its advantages can be understood by referring to the present drawings. In the present drawings, like numerals are used for like and corresponding parts of the accompanying drawings.

Figure 1:
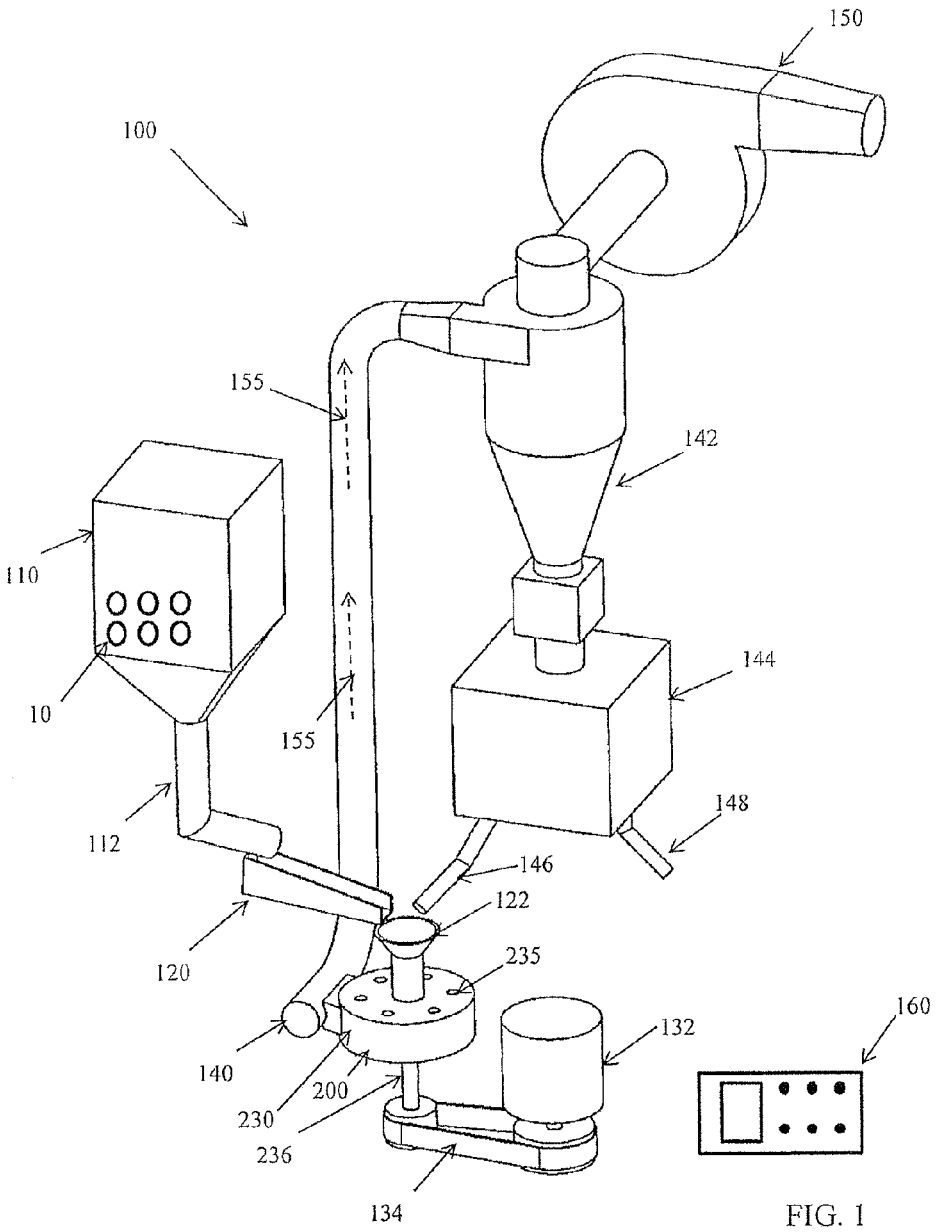
FIG. 1 is a drawing showing an overall reducing machine including the mill assembly according to one embodiment of the present invention.

As shown in FIG. 1, in one embodiment of the present invention, there is provided a reducing machine or system, shown generally by reference numeral 100, for reducing input material shown generally by reference numeral 10. The input material 10 is generally held in a hopper 110, which has an input chute 112 leading to a tray 120 which allows the input material 10 to fall into a funnel 122. The funnel 122 is connected to a mill assembly, as shown generally by reference numeral 200. The mill assembly 200 comprises a mill housing 230 which houses a stationary disc 300 and a rotating disc 500 (not shown in FIG. 1).

The reducing machine 100 also comprises a motor 132 for rotating a rotating shaft 136 (shown in FIG. 2) by means of a belts 134 or any other type of mechanical connection. The rotating shaft 136 is housed in a rotating shaft housing 236 connected to the rotating disc 500 such that the motor 132, belts 134 and shaft 136 cause the rotating disc 500 to rotate about the longitudinal axis $L_A$ with respect to the stationary disc 300.

The system 100 comprises a fan 150 which creates a negative air pressure in the duct 140 and causes air to flow along a path shown generally by the dashed arrow and identified generally by reference numeral 155. The reduced material (shown generally by reference numeral 11 in FIG. 2) is generally entrained in the air flow 155 caused by the fan 150 and thereby removed from the mill assembly 200. In one aspect of the present invention, air enters in the mill assembly 200 through air inlets 235 located on the housing lid 232 of the mill housing 230 to cool the stationary disc 300.

The reduced material 11 entrained in the air flow 155 passes through the duct 140, the cyclone 142 into a separator 144. Generally, there is a filter (not shown) from the fan 150 exhaust to prevent reduced material 11 exiting to the environment. The separator 144 will direct the properly reduced material 11 to the "good" material chute 148 where it can be then used as required. Any reduced material 11 that has not been properly reduced is directed through the "oversized" material chute 146 and re-fed into the funnel 122 together with the input material 10 to be processed in the mill assembly 200. A controller, shown generally by reference numeral 160 controls the reducing machine 100 and may comprise sensors, such as temperature sensors (not shown) to sense the temperature of the reducing machine 100 at different locations.

Figure 2:
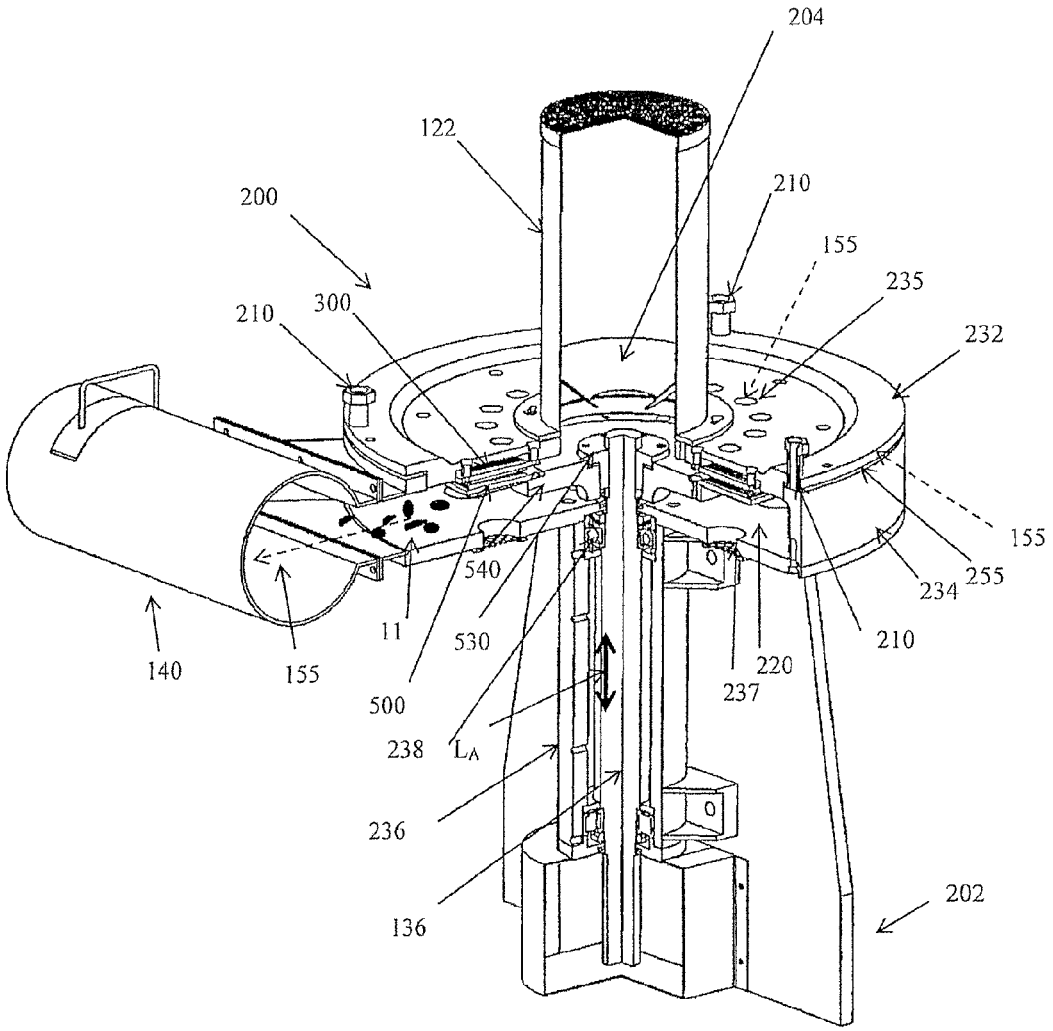
FIG. 2 illustrates a mill assembly with a quarter section removed according to one embodiment of the present invention.

FIG. 2 illustrates the mill assembly 200 in greater detail and with a quarter section cut out. As illustrated in FIG. 2, the duct 140 is connected to the side of the mill assembly 200 and air flow 155 passes through the duct 140 with reduced material 11 entrained therein. The duct 140 is in flow communication with the disc chamber 220 containing the stationary disc 300 and rotating disc 500 and also the air inlets 235 in the housing lid 232 and the lower inlets 237 of the housing body 234. As illustrated in FIG. 2, air from the environment is drawn into the mill assembly 200 through the air inlets 235 in the housing lid 232 as well as the air gap 255 in the housing 230 located between the housing lid 232 and the housing body 234 and the lower air inlets 237 in the housing body 234. The air gap 255, as well as the separation of the housing lid 232 from the housing body 234 may be controlled by the adjusting knobs 210 which also adjusts the separation of the rotating disc 300 and stationary disc 500 to control the size of the reduced material 11 either more coarse or more fine.

As illustrated in FIG. 2, the mill assembly 200 is supported on a mill support 202, which in this embodiment is attached to the rotating shaft housing 236 which houses the rotating shaft 136. The rotating shaft 136 is caused to rotate by means of the rotor 132 and belts 134 discussed above and illustrated in FIG. 1. The rotating shaft 136 is connected through a bushing 530 and carrying plate 540 to the rotating disc 500 and causes the rotating disc 500 to rotate about the longitudinal axis $L_A$ on bearing block 238.

In operation, raw material 10 enters the mill assembly 200 through the funnel 122, the lower portion of which is illustrated in FIG. 2. As the material to be reduced 10 enters the funnel 122, it passes through the input orifice 204 in the housing lid 230 and stationary disc 300 and then is drawn between the rotating disc 500 and the stationary disc 300 by the negative air pressure caused by the fan 150 and centrifugal force caused by the rotating disc 500. As the material 10 is being reduced by the two discs 300, 500, the reduced material 11 travels radially outwardly from between the two discs 300, 500 and the reduced material 11 becomes entrained in the air flow 155 in the duct 140. As indicated in FIG. 2, the air entering through the air inlets 235 of the housing lid 232 flows into the disc chamber 220 and is permitted to flow between the housing lid 232 and the stationary disc 300 and then out through the duct 140.

FIGS. 3A to 3D illustrate a preferred embodiment of the stationary disc 300. In this preferred embodiment, the stationary disc 300 is symmetrical about the stationary disc radial plane, shown generally by the dashed lines in FIGS. 3A and 3B and identified generally by reference numeral $S_{RP}$. However, it is understood that the invention encompasses other embodiments where the stationary disc 300 is not symmetrical about the stationary disc radial plane $S_{RP}$.

Figures 3A, 3B, 3C:
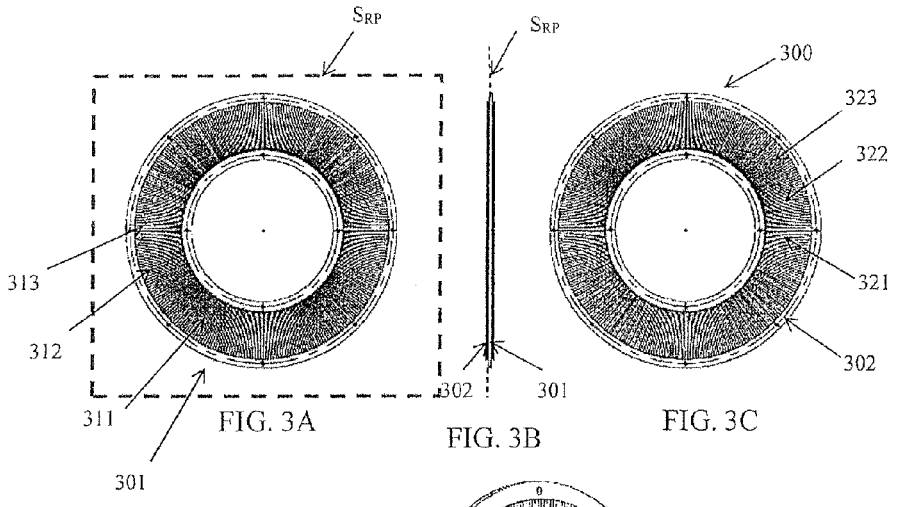
FIGS. 3A-3D illustrate the stationary disc according to one embodiment of the present invention.
Figure 3D:
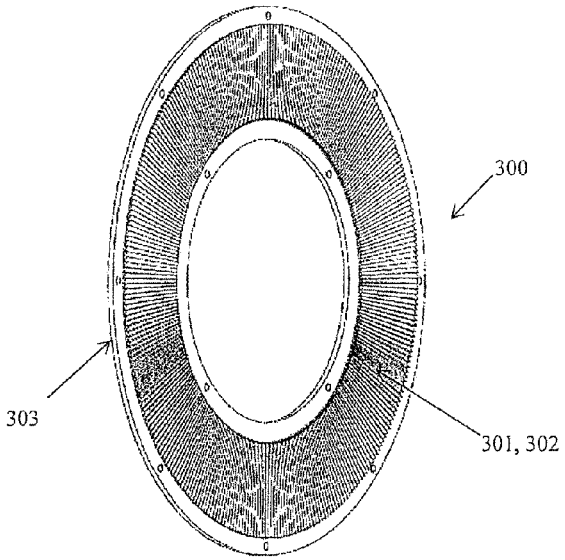

FIG. 3A shows the first side 301 of the stationary disc 300, which preferably comprises a first cutting surface 311. The first cutting surface 311 preferably comprises a plurality of substantially extending cutting edges 312. When the stationary cutting surface 311 is in operative interaction with the rotating disc 500, the stationary disc 300 reduces the raw material 10 to the reduced material 11.

FIG. 3C illustrates the second side 302 of the stationary disc 300 which preferably comprises a stationary air cooling surface 321. The air cooling surface 321 acts as a heat sink, such that when the air cooling surface 321 faces the air inlets 235 of the housing lid 232 and is axially separated therefrom along the longitudinal axis $L_A$ to permit air to flow between the housing lid 232 and the air cooling surface 321 heat is dissipated by the air cooling surface 321. To accomplish this, the air cooling surface 321 preferably but not necessarily has a surface which can facilitate dissipation of heat into the air flow 155. For instance, preferably, the air cooling surface 321 has fins or cooling ridges 323 which preferably extend in a radial direction to permit the air flow 155 to come into contact with a larger surface area, such as in excess of 100%, as compared to a flat surface. In this way, the stationary air cooling surface 321 dissipates heat generated by the stationary disc 300 to the air flow 155 more efficiently.

Accordingly, in one preferred embodiment, the air cooling surface 321 preferably comprises a plurality of radially extending cooling ridges, shown generally by reference numeral 323. This facilitates air cooling of the stationary disc 300 and acts essentially as a heat sink as air flow 155 entering through the air inlets 235 passes between the housing 232 and the air cooling surface 321 to cool the stationary disc 300. Similarly, the cutting surface 311 on the first side 301 has cutting edges 312 which, when the stationary disc 300 is attached to the housing lid 232 in a first orientation, are arranged in facing operative interaction with the rotating cutting surface 511 of the opposed rotating disc 500 to reduce the input material 10.

Preferably, the air cooling surface 321 is in thermal contact with the stationary cutting surface 311. This can be accomplished, for instance, by having a material, generally a metal that is a thermal conductor to conduct heat generated by the cutting surface 311 to the cooling surface 321.

In the preferred embodiment where the stationary disc 300 is substantially symmetrical about the stationary radial plane $S_{RP}$, the plurality of ridges on the air cooling surface 321 also comprises cutting edges 322. In this preferred embodiment, the cutting surface 311 has cutting edges 312, which are themselves oriented on a second plurality of radially extending cooling ridges 313. In this way, the disc 300 can be attached to the housing lid 232 in a second orientation with the first side 301 facing the housing lid 232 and the second side 302 facing the rotating disc 500 to reduce input material 10. In the further preferred embodiment, as illustrated in FIGS. 3A and 3B, where the stationary disc 300 is substantially symmetrical about the radial plane $S_{RP}$, either the first side 301 or the second side 302 can be facing towards the rotating disc 500. Similarly, both the first side 301 and the second side 302 comprise a plurality of ridges 313, 323, which preferably are radially extending in the direction of the air flow 155, such that either plurality of ridges 313, 323 can act as the air cooling surface 321 when they are oriented such as to face the air inlets 235 of the housing lid 232 where air is permitted to flow. Accordingly, in this preferred embodiment, in the second orientation, the plurality of extending ridges of the air cooling surface having cutting edges 322 are arranged in facing operative interaction with the rotating cutting surface of the opposed rotating disc 500 to reduce material 10. Similarly, the plurality of ridges 313 of the cutting surface 311 face the housing lid 232 and the air inlets 235, such that air drawn through the air inlets 235 of the housing lid 232 cross the plurality of cutting ridges of the cutting surface 311 to cool the stationary disc 300 in the second orientation.

Figure 4A:
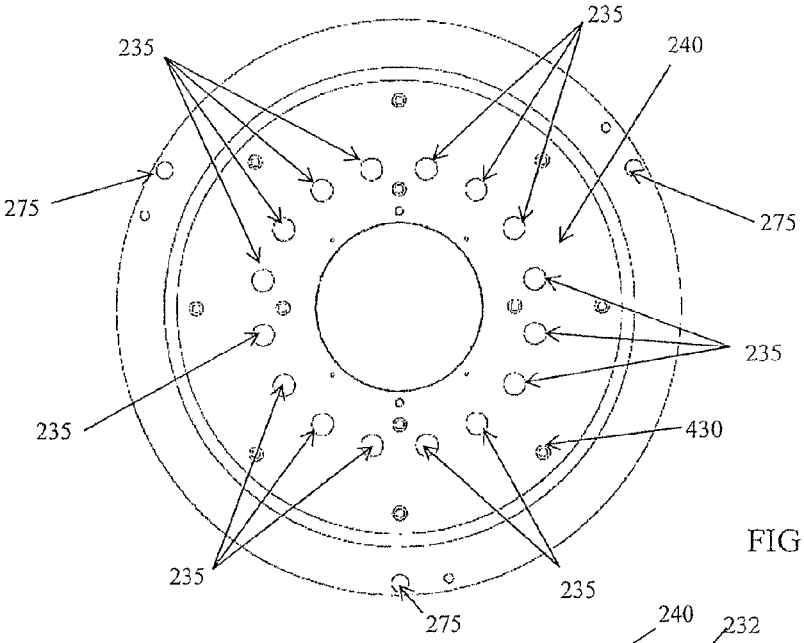
FIGS. 4A, 4B and 4C illustrate the lid of the housing according to one embodiment of the present invention.
Figure 4B:
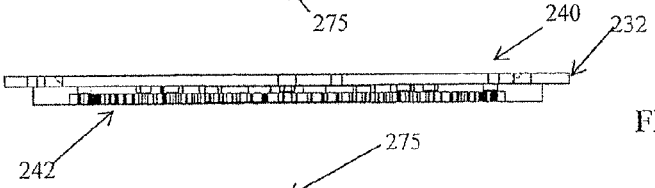
Figure 4C:
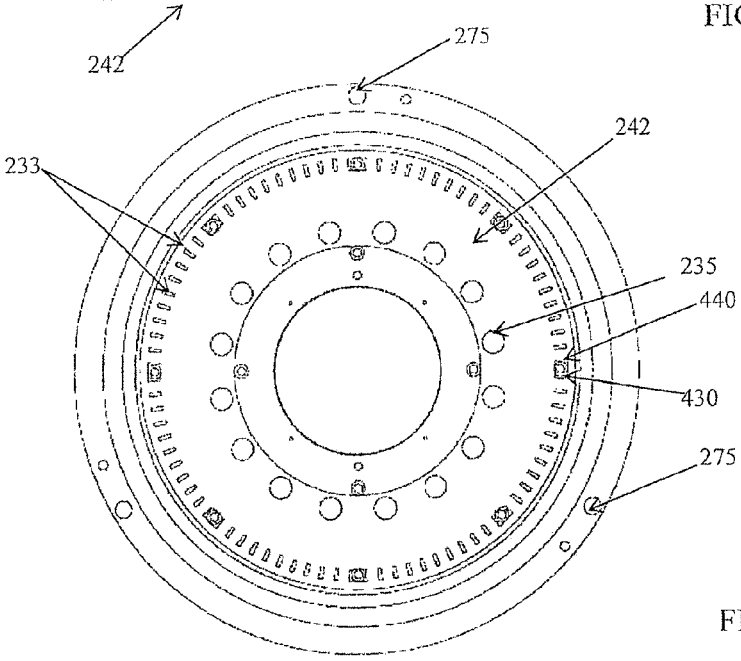

FIGS. 4A, 4B and 4C show the housing lid 232 of the housing 230 for the mill assembly 200 in more detail. As illustrated in FIG. 4A, which shows the external surface 240 of the housing lid 232, the air inlets 235 permit air to flow into the mill housing 230 and specifically between the stationary disc 300 and the inner surface 242 of the housing lid 232 as illustrated in FIG. 4C. The adjustment openings 275 are for the adjusting knobs 210.

As also illustrated in FIG. 4C, and the cross-sectional side view in FIG. 4B, the housing lid 232 preferably comprises support ribs, shown generally by reference numeral 233, that preferably extend from the inner surface 242 of the housing lid 230 axially into the disc chamber 220 a predetermined distance $P_D$ at a radial position along the interior surface 242 of the housing lid 230 corresponding to the radial position of the radial flange 303 of the stationary disc 300 when the stationary disc 300 is attached to the housing lid 232.

Figure 4D:
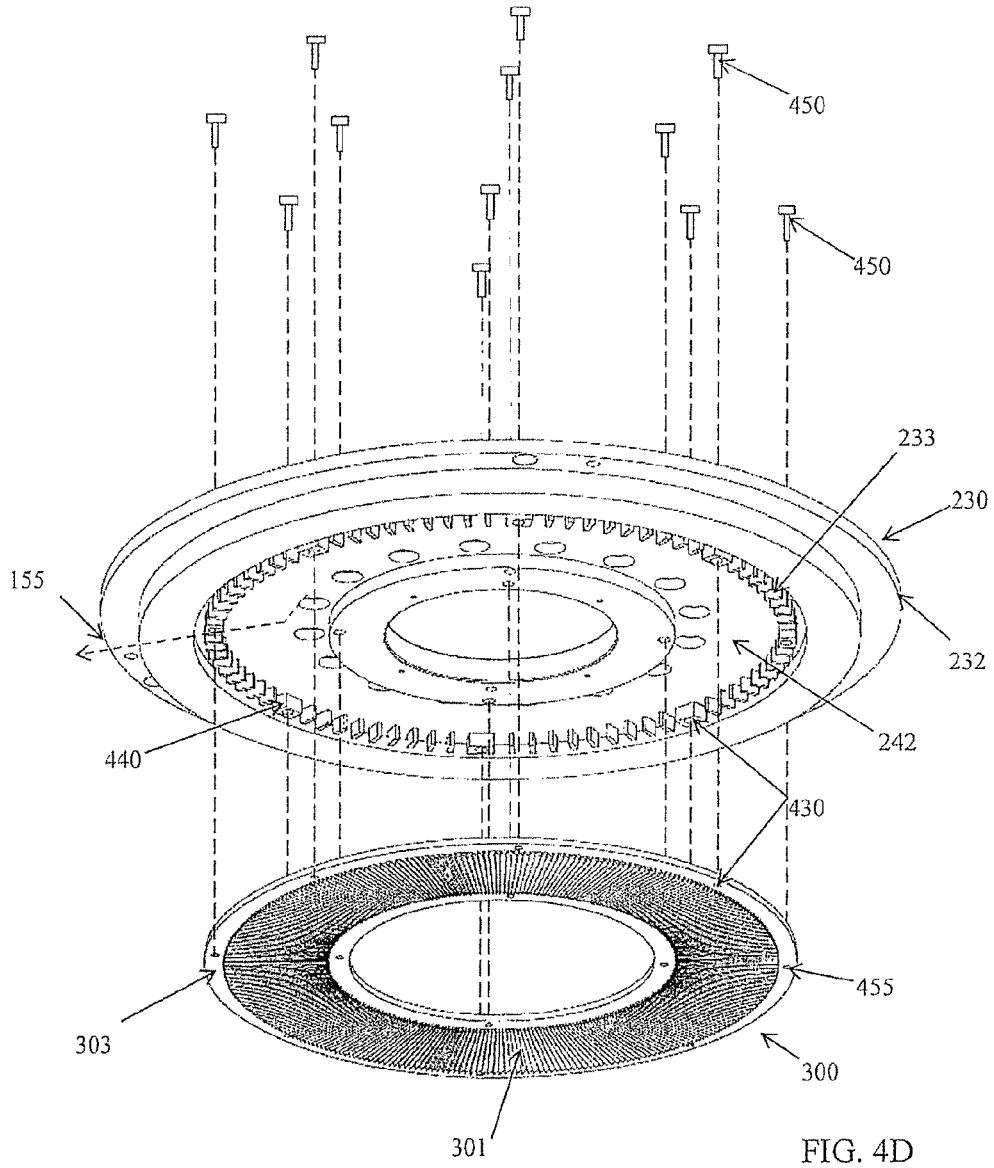
FIGS. 4D and 4E illustrate the stationary disc attaching to the housing lid according to one embodiment of the present invention in an exploded view.

FIG. 4D is an exploded perspective view showing the inner surface 242 of the housing lid 232 having ribs 233 and being attached to the stationary disc 300 by an attachment mechanism, shown generally by reference numeral 430. As illustrated in FIG. 4D, the stationary disc 300 is attached in a first orientation with the first side 301 facing downwards to operatively interact with the rotating cutting surface 511 of the opposed rotating disc 500. The attaching mechanism 430 in this preferred embodiment comprises screws 450 which pass through openings 455 in the radially flange 303 of the stationary disc 300 and engage corresponding openings 441 in the attaching rib 440 located at corresponding radial positions along the inner surface 242 of the housing lid 232.

Figure 4E:
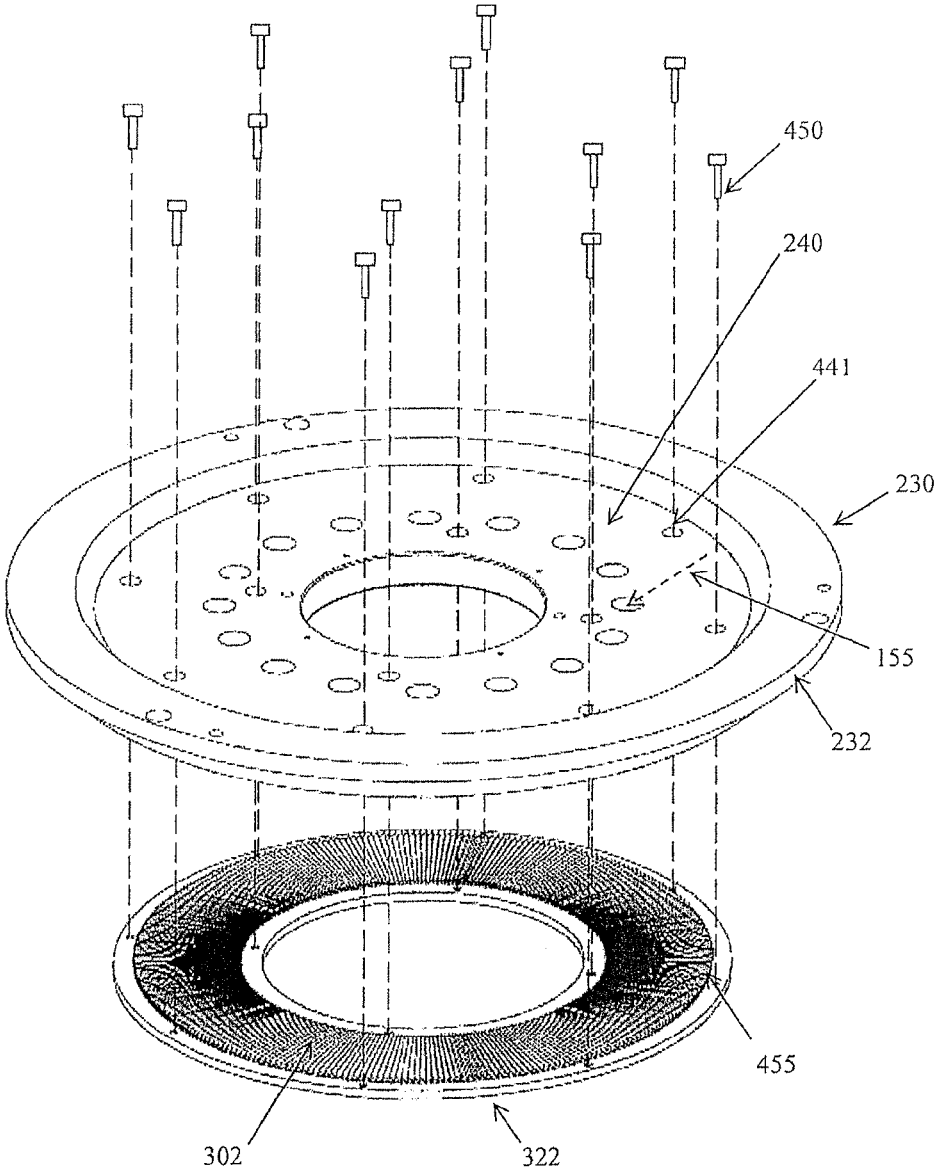

As illustrated in the exploded perspective view of FIG. 4E, in this preferred embodiment the screws 450 pass through the openings 441 in the housing lid 232 through the attaching ribs 440 and engage the corresponding openings 455 in the disc 300. However, it is understood that the attaching mechanism 430 is not limited to such an arrangement of screws 450 and corresponding openings 441, but rather any type of attaching mechanism 430 could be used to operatively attach the stationary disc 300 to the housing lid 232.

In a further preferred embodiment, the attaching ribs 440 extend from the interior surface of the lid housing 232 the same predetermined distance $P_D$ as the supporting ribs 233. In this way, the supporting ribs 233 and the attaching ribs 440 support the stationary disc 300 a predetermined distance from the interior surface 242 of the housing lid 232 to permit the air to flow from the air inlets 235 over the air cooling surface 321, between the gaps 239 of the support ribs 233, and where present between the attaching rib 440 and the support rib 233, to form an air channel 245 from the air inlet 235 to the duct 140. The support ribs 233 thereby form gaps or air passages 239 for the passage of air from the stationary air inlets 235.

Figure 4F:
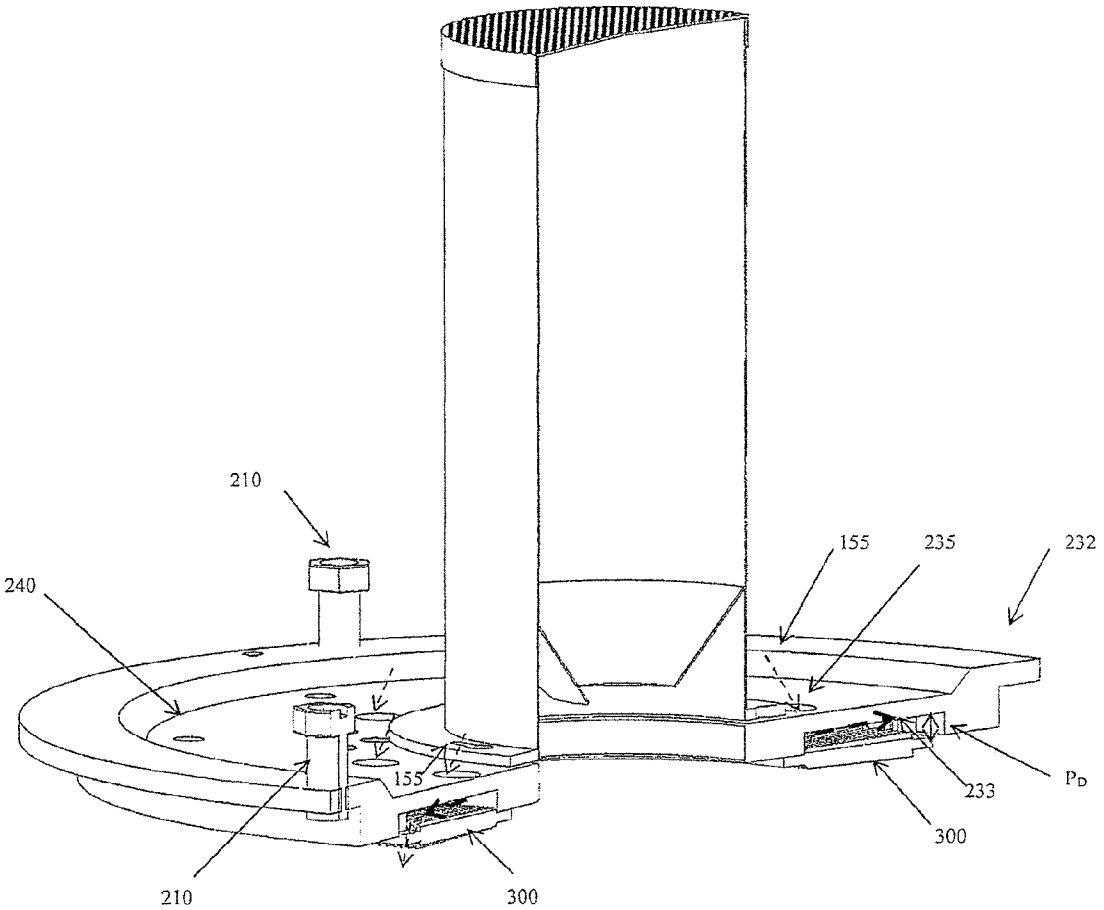
FIG. 4F illustrates the stationary disc attached to the housing lid.
Figure 4G:
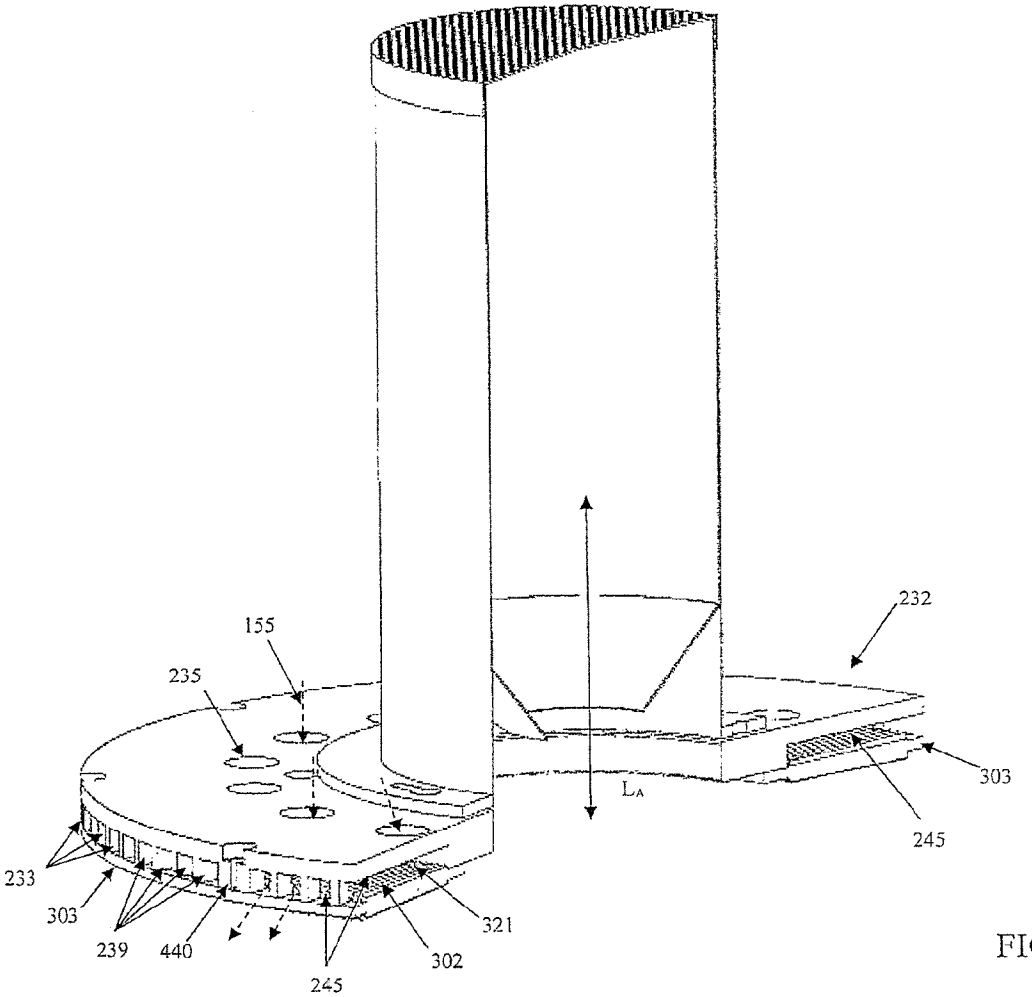
FIG. 4G illustrates the stationary disc attached to the housing lid, but with a portion of the housing lid removed.

FIGS. 4F and 4G show the stationary disc 300 attached to the housing lid 232, with a portion of the housing lid 232 removed in FIG. 4G to better illustrate the air flow 155. As illustrated, in FIGS. 4F and 4G, the radial flange 303 is operatively attached to the attaching ribs 440 which extend axially along the Longitudinal Axis $L_A$ from the inside surface 242 of the housing lid 232 to axially separate the second side 302 of the stationary disc 300 from the inside surface 242 of the housing lid 232 to form the air channel, shown generally by reference numeral 245, from the air inlet 235, across the cooling surface 321, through the gaps 239 between the support ribs 233 and/or attaching ribs 240 and over the flange 303. Accordingly, the support ribs 233 extend axially inwardly from the inside surface 242 of the housing lid 232 a distance $P_D$ and engage the flange 303 to support the stationary disc 300 against the movement of the rotating disc 500 and the input material 10 and direct air flow 155 from the air inlets 235 through the gaps 239 between the radial flange 303 and supporting ribs 233 (as well as the attaching ribs 440 where present) to form an air channel 245 channelling the air flow 155 over the cooling surface 321 and exiting through the stationary air passages or gaps 239 and into the disc chamber 230.

In a preferred embodiment, where the stationary disc 300 is substantially symmetrical about the radial plane $S_{RP}$, once the cutting edges 313 on the cutting surface 311 are dulled, the stationary disc 300 can be removed from the housing lid 232. In a preferred embodiment, the attaching mechanism 430 operatively releasably attaches the stationary disc 300 to the lid housing 232 in the first orientation with the cutting surface facing 311 the rotating disc 500 and can then re-attach the stationary disc 300 in a second orientation with the cooling surface 321 facing the rotating disc 500. In this preferred embodiment, as indicated above, the cooling surface 321 will have cutting edges 323 on the plurality of cooling ridges 322 such that the cooling surface 321 can act as a second cutting surface 311'. Similarly, the cutting surface 311 will have a plurality of cooling ridges 312 upon which the cutting edges 313 are oriented, such that the cutting surface 311 can also act as a second cooling surface 321'. In this way, the longevity of the stationary disc 300 can be effectively doubled. In a further preferred embodiment, the stationary disc 300 has a relatively thin thickness, such that once the cutting edges 313 on the cutting surface 311 and the cutting edges 323 or the cooling surface 321 are dulled, the stationary disc 300 can simply be discarded and a new disc 300 can be operatively attached to the housing lid 232 for continued use in the milling assembly 200.

Figure 5A:
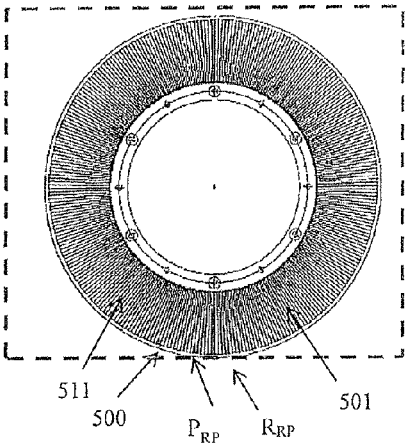
FIGS. 5A-5D illustrate the rotating disc according to one embodiment of the present invention.
Figure 5B:
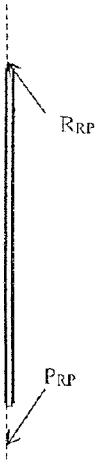
Figure 5C:
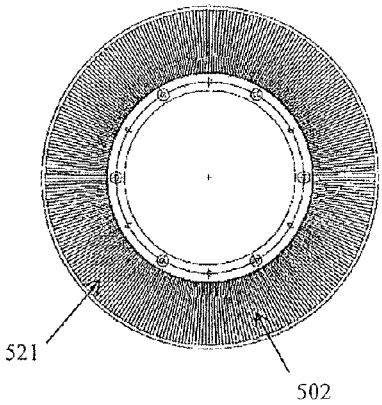
Figure 5D:
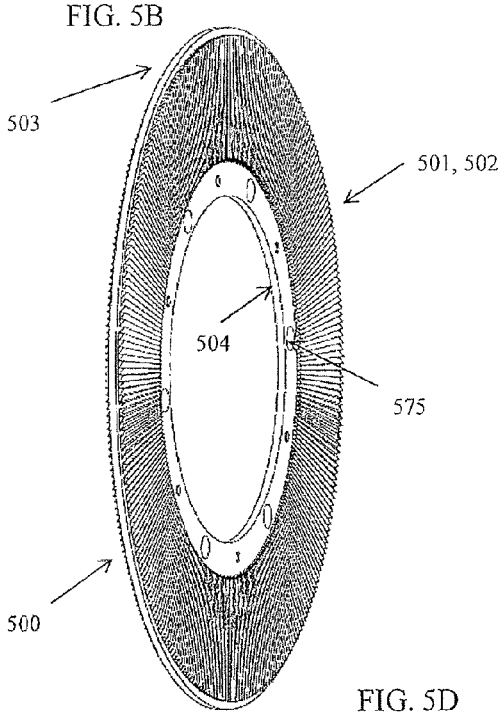
Figure 6A:
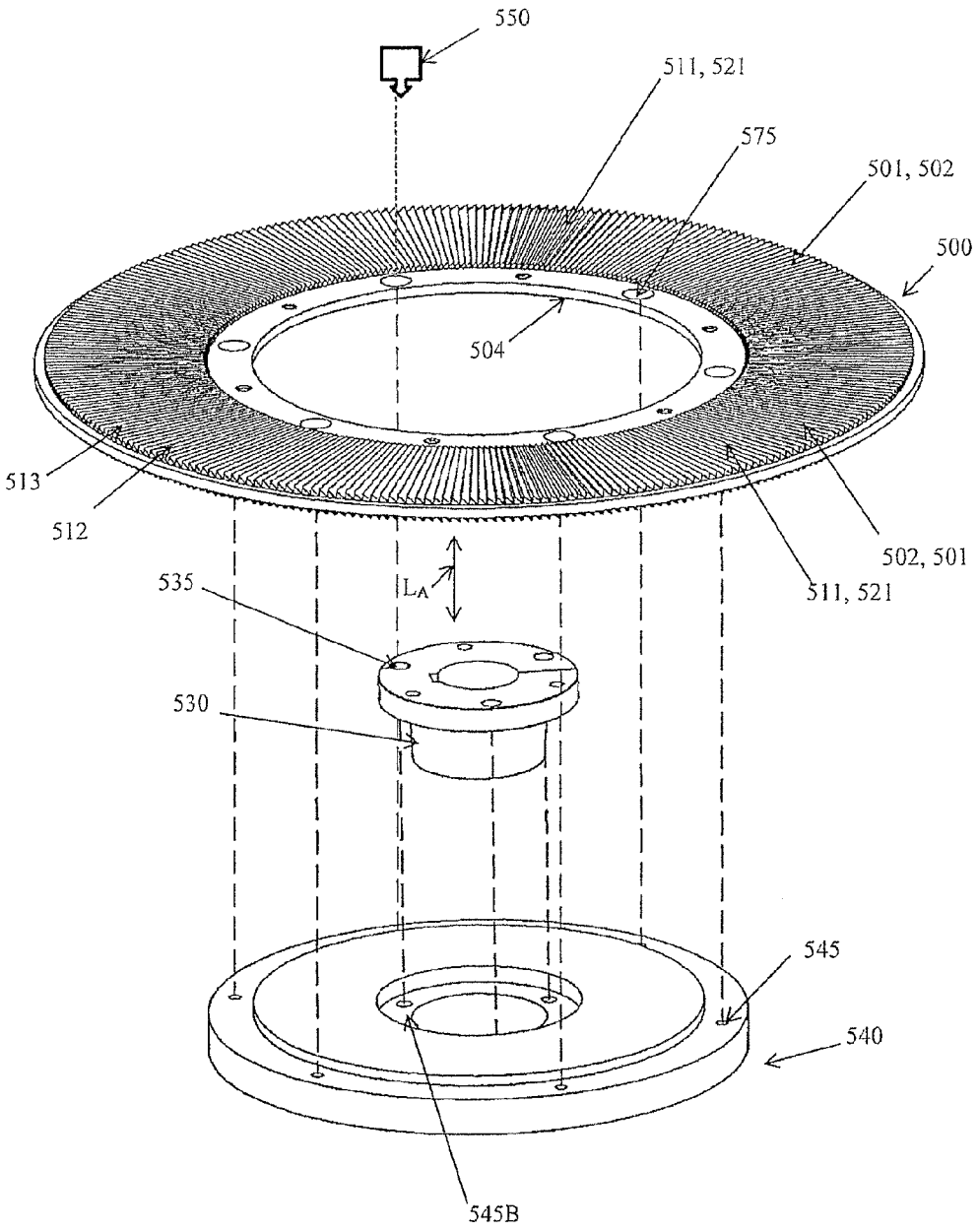
FIG. 6A illustrates the rotating disc attaching to the carrying plate according to one embodiment of the present invention.
Figure 6B:
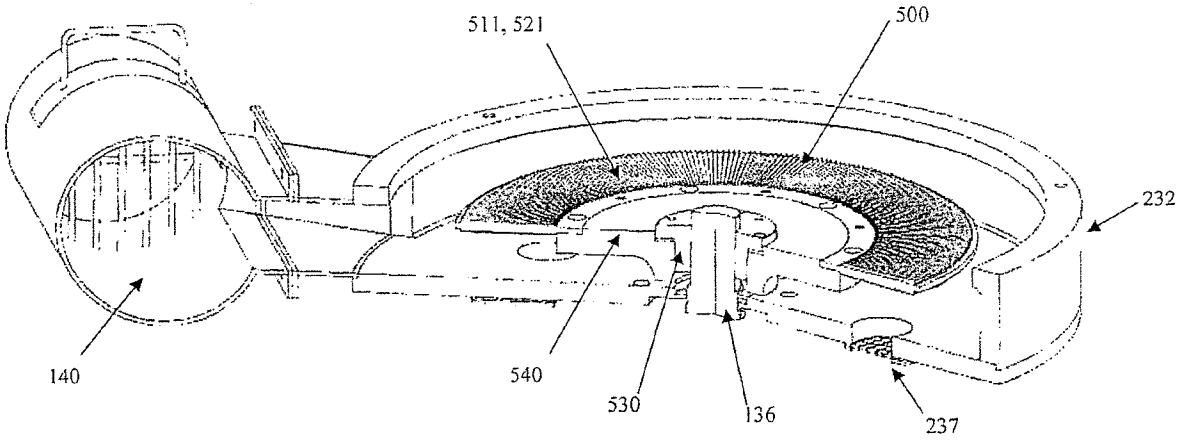
FIG. 6B illustrates the rotating disc in the mill assembly.

FIGS. 5A to 5D illustrate the rotating disc 500 according to one preferred embodiment. As with the stationary disc 300, the rotating disc 500 is preferably symmetrical about the central radial plane, which is illustrated in FIGS. 5A and 5B by the dashed line and identified generally by the reference numeral $R_{RP}$ identifying the central radial disc radial plane. However, it is understood that the radial disc 500 may have other orientations and shapes and need not necessarily be symmetrical about the central radial disc radial plane $R_{RP}$. In a preferred embodiment shown in FIGS. 5A to 5D, the rotating disc 500 has preferably a first side 501 shown in FIG. 5A, and a second side 502, shown in FIG. 5C. The first side 501 preferably has a first cutting surface 511 and the second side 502, preferably has a second cutting surface 521. In a preferred embodiment, where the rotating disc 500 is substantially symmetrical about the radial disc radial plane $R_{RP}$, it is understood that the first cutting surface 511 will be substantially identical to the second cutting surface 521. As illustrated in FIG. 6, the first and second cutting surfaces 511, 521 of this embodiment have respective radial ridges 512, 522, having sharpened edges 513, 523, respectively. This is shown best in FIG. 6 with the understanding that in this preferred embodiment, the first side 501 is substantially the same as the second side 502. As illustrated best in FIG. 6A and 6B, the rotating disc 500 is attached to the carrying plate 540. This may be accomplished by a number of means including, as illustrated in FIG. 6, having a securing device 550, such as a screw, bolt, etc. going through holes 575 on the inner attaching flange 504 and corresponding holes 545 on the carrying plate 540 to attach the rotating disc 500 to the carrying plate 540.

Furthermore, as also illustrated in FIGS. 6A and 6B, the carrying plate 540 is itself attached to a bushing 530. This can be accomplished through other securing devices going through the holes 535 in the bushing 530 and corresponding holes 545B in the carrying plate 540. The bushing 530 and carrying plate 540 can then be connected to the rotating shaft 136 discussed above. When the rotating disc 500 is attached to the carrying plate 540, the rotating shaft 136 will rotate the rotating disc 500 about the longitudinal axis $L_A$ as shown generally by reference in FIGS. 6A and 6B corresponding to the longitudinal axis $L_A$ shown in FIG. 2.

Similar to the stationary disc 300, the rotating disc 500 can be attached to the carrying plate 540 and then fixed to the rotating shaft 136 in a first orientation, where the first cutting surface 511 is facing the stationary disc 300 to reduce input material 10. This would be the case, for instance, when the first side 501 is facing away from the carrying plate 540. In this first orientation, the first cutting surface 511 can interact with the corresponding cutting surface 311 of the stationary disc 300 to reduce input material 10. Once the first rotating cutting surface 511 is no longer functional for reducing input material 10, such as if the edges 513 have become dull, the rotating disc 500 can be detached from the carrying plate 540 and re-attached in a second orientation, with the second rotating cutting surface 521 facing the stationary disc 300 to reduce input material 10. In this way, the effective useful life of the rotating cutting disc 500 can be doubled. Preferably, the rotating disc 500 and the stationary disc 300 are changed from their respective first orientation to their respective second orientation, at the same time, to minimize maintenance time.

As with the stationary disc 300, the rotating disc 500 has cooling ridges 513, 523 on each sides 501, 502. In this way, the cutting edges 512, 522 are oriented on the cooling ridges 513, 523. Furthermore, the rotation of the rotating disc 500 cause air to flow over the surface 511, 521 which is not operatively facing the stationary disc 300, and the ridges 513, 523 facilitate cooling of the rotating disc 500. In this way, the side 501, 502 facing away from the stationary disc 500 acts as the rotating cooling surface 521 and the side 502, 501 facing the stationary disc 300 acts as the rotating cutting surface 511.

As with the stationary disc 300, in a preferred embodiment, the rotating disc 500 has a relatively thin thickness, such that once the cutting edges 511, 521 are dulled, the rotating disc 500 can be simply discarded. A further advantage of having a relatively thin rotating disc 500 is that the weight of the rotating disc can be reduced, decreasing the transportation cost of the rotating disc 500, as well as, decreasing the thrust load on the bearing block 238 and the associate wear and tear, and also will be easier to cool because of its lower mass.

A further advantage of the preferred embodiment, where the rotating disc 500 is substantially symmetrical about the central radial disc radial plane $R_{RP}$, is that the rotating disc 500 will also be substantially symmetrical about the plane of rotation of the rotating disc $P_{RP}$ as shown generally by the symbol $P_{RP}$, and, substantially coincides with the dashed lines of the central radial disc radial plane $R_{RP}$. This facilitates stability of the central rotating disc 500 as it rotates with respect to the stationary disc 300. Also, having the radial disc radial plane $R_{RP}$ substantially coincident with the plane of rotation of the rotating disc $P_{RP}$ when the rotating disc 500 is attached at rotating shaft 136, avoids flexing of the rotating disc 500 due to centrifugal force, which could be caused, for instance, if the radial disc 500 has a centre of mass which deviated from the plane of rotation of the rotating disc 500.

During initial operation, when the reducing machine 100 is cold and not yet warmed up to the optimal operating temperature, reducing material 10 will be inserted into the hopper 110 and reduced in order to initially heat or warm up the reducing machine 100. As indicated above, the fan 150 will draw air through the air inlets 235 and across the air cooling surface 321 of the stationary disc 300. As the air passes between the housing lid 232 and the air cooling surface 321, the air will absorb heat from the air cooling surface 321 that is generated from the cutting surface 311 of the stationary disc 300. This warmed air will then travel through the ducts 140 with the entrained reduced material 11 and facilitate warming the reducing machine 100 so that it may more quickly reach the optimal operating temperature to properly process input material 10. In this way, the air cooling surface 321 facilitates the initial warming of the reducing machine 100 thereby lessening the warm up time, the off-spec material prior to the system 100 reaching the optimal operating temperature and the corresponding wear and tear on the discs 300, 500. It is understood that in the preferred embodiment where the stationary disc 300 is substantially symmetrical about the stationary disc radial plane $S_{RP}$, the same effect will arise if the stationary disc 300 is in the second orientation with the cutting surface 311 facing the air inlets 235 of the housing lid 232 and acting as the second stationary air cooling surface 321'.

As described above, in a preferred embodiment, the stationary disc 300, rotating disc 500 and mill assembly 200 are used in a reducing machine or system 100 which is preferably a pulverizing apparatus to reduce the input material 10 to essentially powder. It is understood, however, that the stationary disc 300, rotating disc 500 and milling machine 200 could be used in other types of reducing machines or systems 100 and are not necessarily restricted to pulverizing machines. It is also understood that in one embodiment, the air inlets 235 could be periodically closed or obstructed intentionally. This can be the case, for instance, to control the temperature of the mill assembly 200 and the reducing machine 100 as a whole. For instance, at the initial start up, one or more of the air inlets 235 could be blocked in order to decrease the air passing over the air cooling surface 321 of the stationary disc 300 to facilitate initial heating of the reducing machine 100.

Figure 7A:
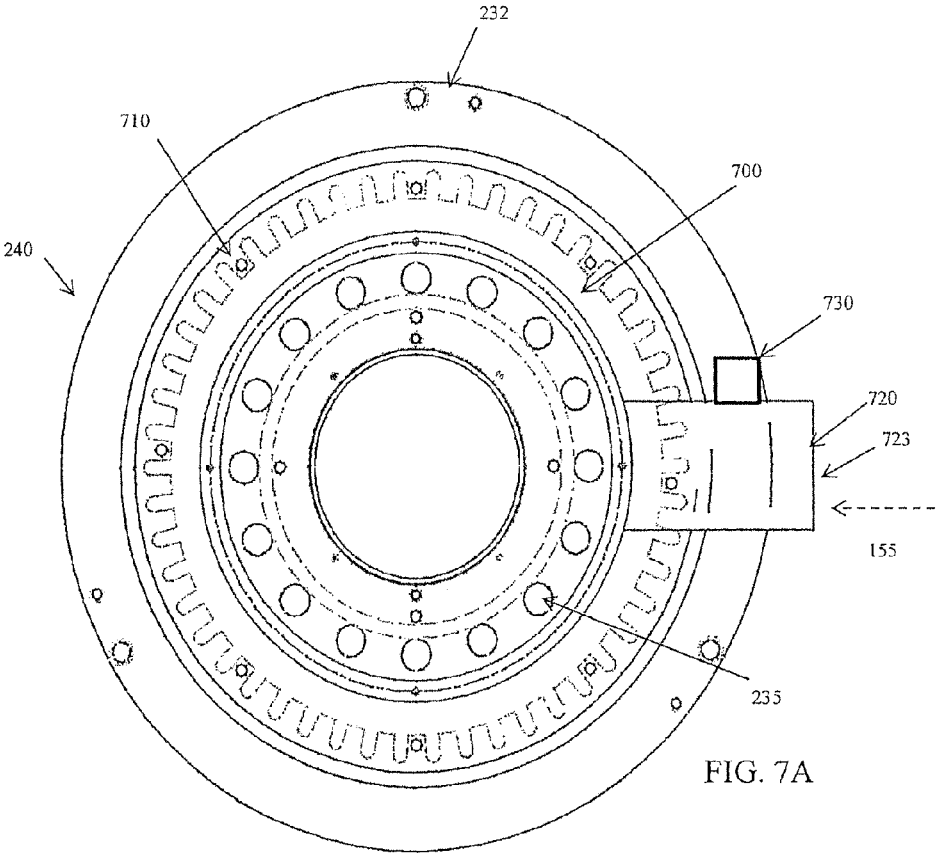
FIG. 7A illustrates a top view of an air restricting device attached to the housing lid according to one preferred embodiment of the present invention.
Figure 7B:
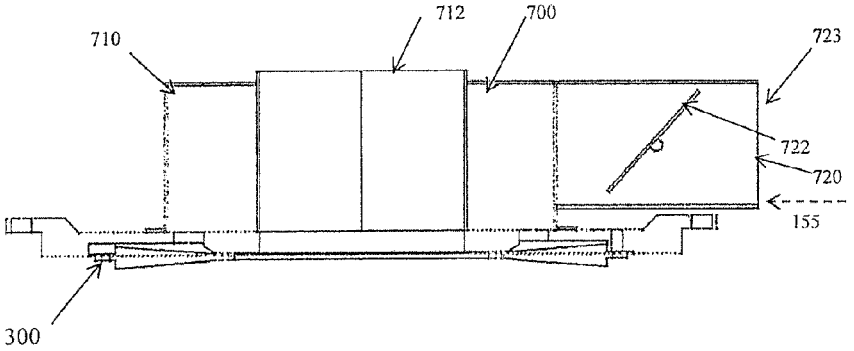
FIG. 7B illustrates the side view of the air restricting device shown in FIG. 7A.

In a further preferred embodiment, as illustrated in FIGS. 7A and 7B, the present invention provides an air restricting device, shown generally by reference numeral 700. The air restricting device 700 preferably rests upon, or is attached to, the external surface 240 of the housing lid 232. For ease of illustration, the air inlets 235 are shown in dashed lines. This reflects that the air restricting device 700 rests on top of the air inlets 235 to guide air into the air inlets 235 from the environment.

Preferably, the air restricting device 700 comprises an air baffle as shown generally by reference numeral 710, which has a central orifice 712, which is coincident with the input orifice 204 to permit input material 10 to enter the mill assembly 200.

The air baffle 710 is in fluid communication with an air damper, as shown generally by reference numeral 720. The air damper 720 has a flange 722 or other type of air restricting member which has an open position, permitting air flow through the damper opening 723 of the damper 720, and a closed position restricting air flow through the damper opening 723 of the damper 720. Preferably, the air restricting device 700 comprises a mechanical control, such as a solenoid or stepper motor as shown generally by reference numeral 730, to control movement of the flange 722 from the open position to the closed or restricted position. In a preferred embodiment, the mechanical motor 730 can adjust the position of the flange 722 at a plurality of different angles to more precisely control the air flow 155 through the damper 720 and therefore through the air inlets 235.

In operation, when it is desired to raise the temperature of the reducing machine 100, the damper 720 is moved to the closed or restricted position to restrict the air flow 155 through the damper 720, the air baffle 710 and the air inlets 235. In this way, the air cooling effect of the air cooling surface 321 on the stationary disc 300 is limited as the air flow 155 across the air cooling surface 321 is decreased thereby preventing the dissipation of heat through convection across the plurality of radially extending cooling ridges 323. When the reducing machine 100 is at a desired temperature and further heating is not required, the damper 720 is moved to the open position permitting air flow 155 through the damper opening 723, through the air baffle 710 to the air inlets 235 and across air cooling surface 321 thereby facilitating cooling of the stationary disc 300. It is understood that because air is a less aggressive form of cooling compared to water or other liquids which have a higher heat capacity, opening the air damper 720 when the reducing machine 100 and, in particular, the stationary disc 300 is at an optimal temperature, will not damage or adversely affect the stationary disc 300.

In a further preferred embodiment, during initial start up, the air restricting device 700 restricts the flow of air through the air inlet 235. This can be accomplished in the preferred embodiment by moving the flange 722 to the closed position restricting air flow 155 through the damper 720. In this way, as input material 10 is passed through the reducing machine 100 during initial start up, the heat generated by the disc mill assembly 200 will be retained within the reducing machine 100 in order to facilitate initial heating at start up. Once the initial heating of the reducing machine 100 is completed and the reducing machine 100 is at the operating temperature, the air control device 700 will permit air flow 155 through the air inlets 235 to cool the stationary disc 300. Because the heat capacity of air is not as high as liquids, such as water, the stationary disc will not experience thermal shock when the air restricting device 700 permits air flow 155 through the air inlets 235 even if the stationary disc 300 and reducing machine 100 are at the operating temperature. In this way, preheating at initial start up, as well as the generation of off spec material and the corresponding wear and tear on the reducing machine 100, can be reduced. In a preferred embodiment the controller 160 will comprise temperature sensors (not shown) to sense the temperature of the reducing machine 100 at different locations. The controller 160 may then also automatically control the air restricting device 700 to permit air flow 155 through the air inlets 235 when initial heating of the reducing machine 100 is completed. For instance, the controller 160 may send a signal to the motor 730 to move the flange 722 permitting air flow through the damper 720 as the temperature of the reducing machine 100 approaches the optimal operating temperature.

Figure 8:
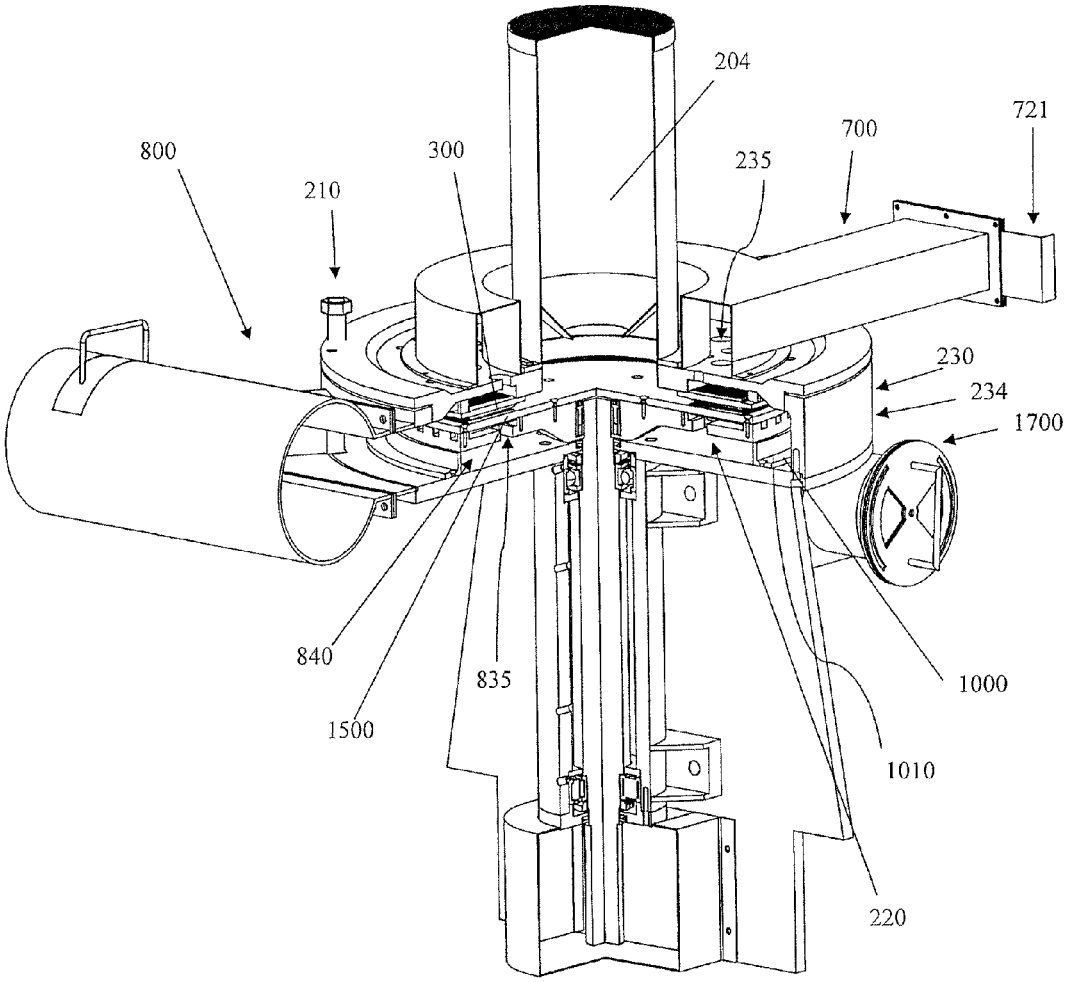
FIG. 8 illustrates a mill assembly with a quarter section removed according to a further embodiment of the present invention having a carrying plate for the rotating disc which channels air across the cooling surface in the rotating disc.

FIG. 8 illustrates a mill assembly 800 in accordance with a further embodiment of the present invention. The mill assembly 800 is shown in FIG. 8 in quarter section cut out, similar to FIG. 2. As illustrated in FIG. 8, most of the components are similar to the mill assembly 200 shown in FIG. 2, except that the rotating disc 1500 is carried by a carrying plate 840 having inlets 835.

As also illustrated in FIG. 8, the stationary disc 300 has an air restricting device 700 with a door 721 which may move across the damper opening 723 (shown in FIG. 12) to restrict air flow through the stationary air inlets 235 as discussed above. However, as also illustrated in FIG. 8, the mill assembly 800 may comprise a rotating air restricting device 1700 for controlling air flow to the rotating disc 1500 through the lower air inlets 237 in the mill housing 230, and, in particular lower air inlets 237 in the housing body 234 of the mill housing 230. The disc chamber 220 contains the stationary disc 300 and rotating disc 1500 and are housed within the mill housing 230.

Figure 14A:
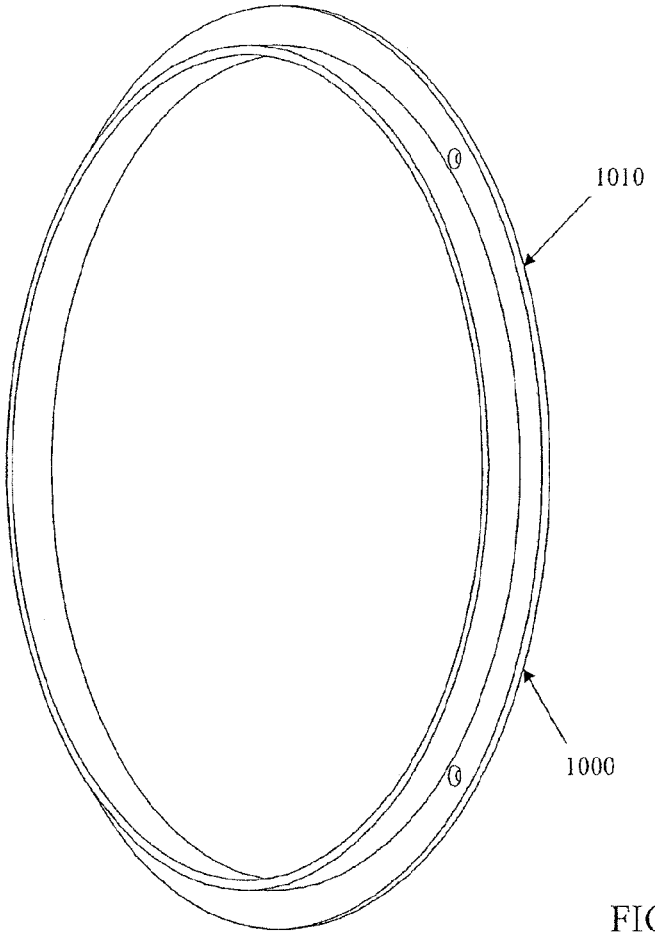
FIGS. 14A, 14B and 14C illustrates perspective front and side views, respectively of the air baffle member according to one preferred embodiment of the present invention.
Figure 14B:
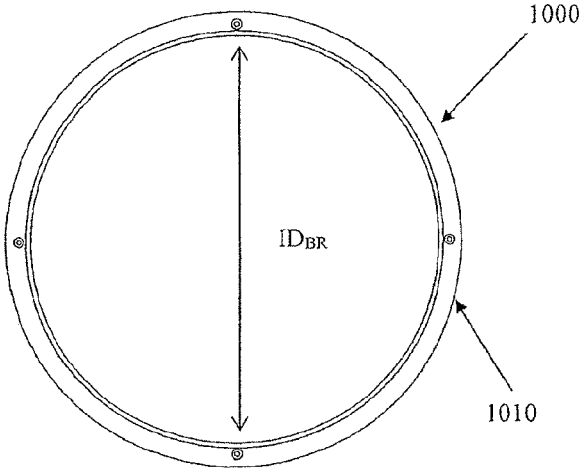
Figure 14C:
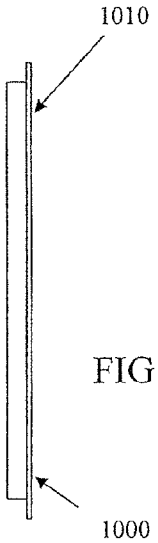

The rotating air restricting device 1700 controls air flow to the rotating disc 1500. To accomplish this, air baffle member 1000 is shown fixed to the inside surface of the housing body 234 and is designed to direct air from the lower air inlets 237 to cool the rotating disc 1500 through rotating air inlets 835 in the carrying plate 840 discussed below. The air baffle member 1000 may have any shape to permit this function. In a preferred embodiment, the air baffle member 1000 is preferably an air baffle ring 1010 (shown in FIGS. 8 in the mill 800 and shown separately in FIGS. 14A, 14B and 14C), and has an inner diameter $ID_{RB}$ slightly greater than the outer diameter $OD_{CP}$ of the carrying plate 840 (See FIG. 9B) to direct the air flow 1155 through the lower air inlets 237 and towards the rotating air inlets 835. The air baffle member 1000 also has the effect of preventing entrained reduced material 11, which is radially exiting from between the stationary disc 300 and the rotating disc 1500, from exiting through the lower air inlets 237. Preferably, the shape of the air baffle member 1000, channels air from the lower air inlets 237 to the air inlets 835 of the carrying plate 840. Likewise, in the preferred embodiment, the air baffle member 1000 has a height from the inside surface of the housing body 234 to direct air to the air inlets 835 with minimal spillage to the disc chamber 220. In the preferred embodiment where the air baffle member 1000 comprises an air baffle ring 1010, the inner diameter $ID_{BR}$ of the baffle ring 1010 should not be greater than the outer diameter $OD_{CP}$ of the carrying plate 840 to avoid leakage of cool air from the lower inlets 237 into the disc chamber 220 without passing through the air inlets 835 of the carrying plate 840. The lower air inlets 237 are preferably arranged so as to be substantially encompassed within the inner diameter $ID_{BR}$ of the baffle ring 1010 to channel air from the lower air inlets 237 to the air inlets 835 of the carrying plate 840. The air baffle member 1000 also has the effect of channelling fresh cool air from outside the disc chamber 220 to avoid internal re-circulation of warm air exiting from between the discs 300, 1500 to further cool the rotating disc 1500 and the disc assembly 800 as a whole.

Figure 9A:
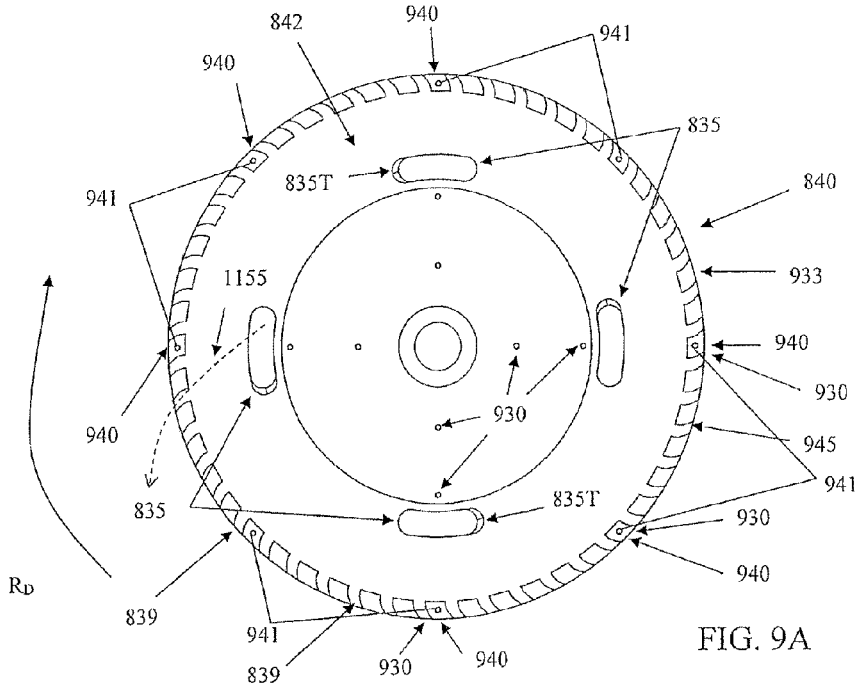
FIGS. 9A, 9B and 9C illustrates the inside view, side view and rear view, respectively of the carrying plate according to the preferred embodiment illustrated in FIG. 8.
Figure 9B:
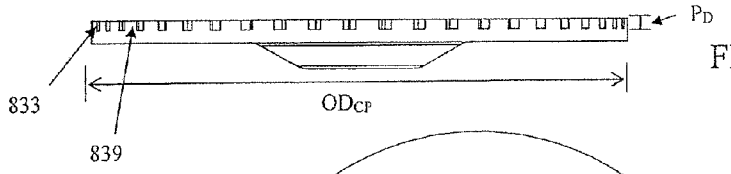
Figure 9C:
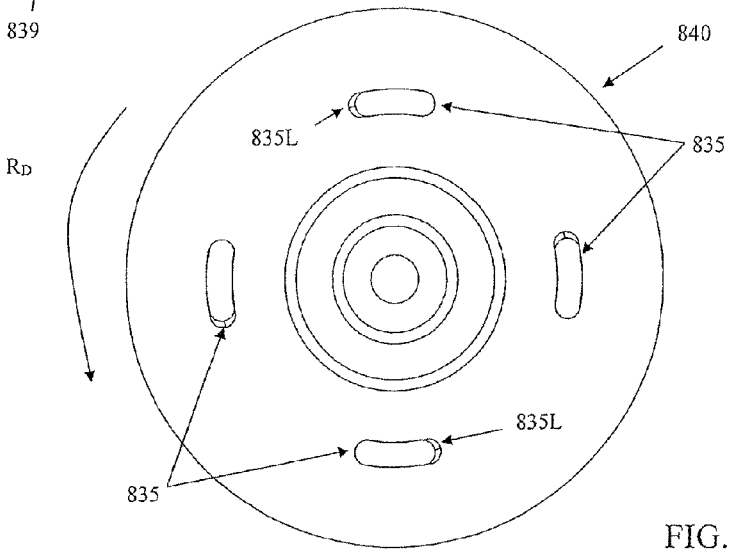

FIGS. 9A, 9B and 9C illustrate an inside view, side view and outside view, respectively, of the carrying plate 840 according to one preferred embodiment of the invention. The carrying plate 840 comprises at least one, and preferably two, four or more air inlets 835. Preferably, the air inlets 835 are equally radially spaced along the carrying plate 840 and permit air to enter from the lower air inlets 237.

The carrying plate 840 also preferably comprises an attaching mechanism, shown generally by reference numeral 930, for operatively attaching the rotating disc 1500 to the carrying plate 840. The rotating disc 1500 is preferably attached to the carrying plate 840 with the non-operating surface, also referred to as the rotating air cooling surface 1521, facing the air inlets 835 and axially separated therefrom to permit air flow from the air inlets 835, between the carrying plate 840 and the rotating air cooling surface 1521 of the rotating disc 1500.

The carrying plate 840 also preferably comprises air passages, shown generally by reference numeral 839, located between the rotating disc 1500 and the carrying plate 840. More preferably, the air passages 839 are located radially remotely from the air cooling surface 1521. In a further preferred embodiment, the air passages 839 are located along the outer perimeter of the carrying plate 840 and radially distant from the air inlets 835. In this way, as the carrying plate 840 and rotating disc 1500 attached thereto rotate in a rotating direction $R_D$, air is channeled from the air inlets 835, between the carrying plate 840 and the rotating air cooling surface 1521, and through the plurality of air passages 839. The air path is shown by dashed lines and identified by reference numeral 1155. The centripetal force caused by the rotation of the carrying plate 840 and disc 1500, together with the vacuum caused by the fan 150, cause air to enter the air inlets 835 and flow along the air path 1155 and through the air passage 839. In a further preferred embodiment, the air passages 839 are angled backward from the direction of rotation $R_D$ of the carrying plate 840, as illustrated in FIG. 9A.

In a further preferred embodiment, a plurality of support ribs, shown generally by reference numeral 833, extend axially into the disc chamber 220, a predetermined distance $P_D$ from an inside surface 842 of the carrying plate 840. The plurality of support ribs 833 may form the plurality of air passages 839 therebetween. In this embodiment, the rotating disc 1500 may comprise a rotating flange 1503 which rests against the support ribs 833 when the disc 1500 is attached to the carrying plate 840. Preferably, the ribs 833 are arranged radially about the inside surface 842 at a radial position corresponding to the position of radial flange 1503 when the disc 1500 is attached to the carrying plate 840 so that the disc 1500 may be supported by the flange 1503 resting on the ribs 833. In this way, in a preferred embodiment, the ribs 833 and air passages 839 are located radially distant from the air inlets 835. This causes the air to be channelled along the air path 1155 radially outwardly from the air inlets 835, between the carrying plate 840 and the cooling surface 1521 of the rotating disc 1500 and through the air passages 839 to cool the disc 1500.

In a further preferred embodiment, the plurality of support ribs 833 are backward curved from a direction of rotation $R_D$ of the carrying plate 840 and rotating disc 1500, as shown in FIG. 9A. In this way, as the carrying plate 840 and the rotating disc 1500 rotate in the direction of rotation $R_D$, the backward air passages 839 create a more gentle path for the air to move between the support ribs 833. This also facilitates channelling the flow of air from the air inlets 835, between the carrying plate 840 and rotating cooling surface 1521 and through the air passage 839 between the support ribs 833. This more gentle path through the backward angled air passages 839 may also decrease the amount of noise caused by the carrying plate 840 and rotating disc 1500 as they rotate in the direction of rotation $R_D$. It is understood that the rotating disc 1500 and carrying plate 840 may rotate at several thousand RPMS. Furthermore, in this way, the ribs 833 give the carrying plate 840 fan-like characteristics forcing the air along the air path 1155 and out the passages 839.

Figure 9D:
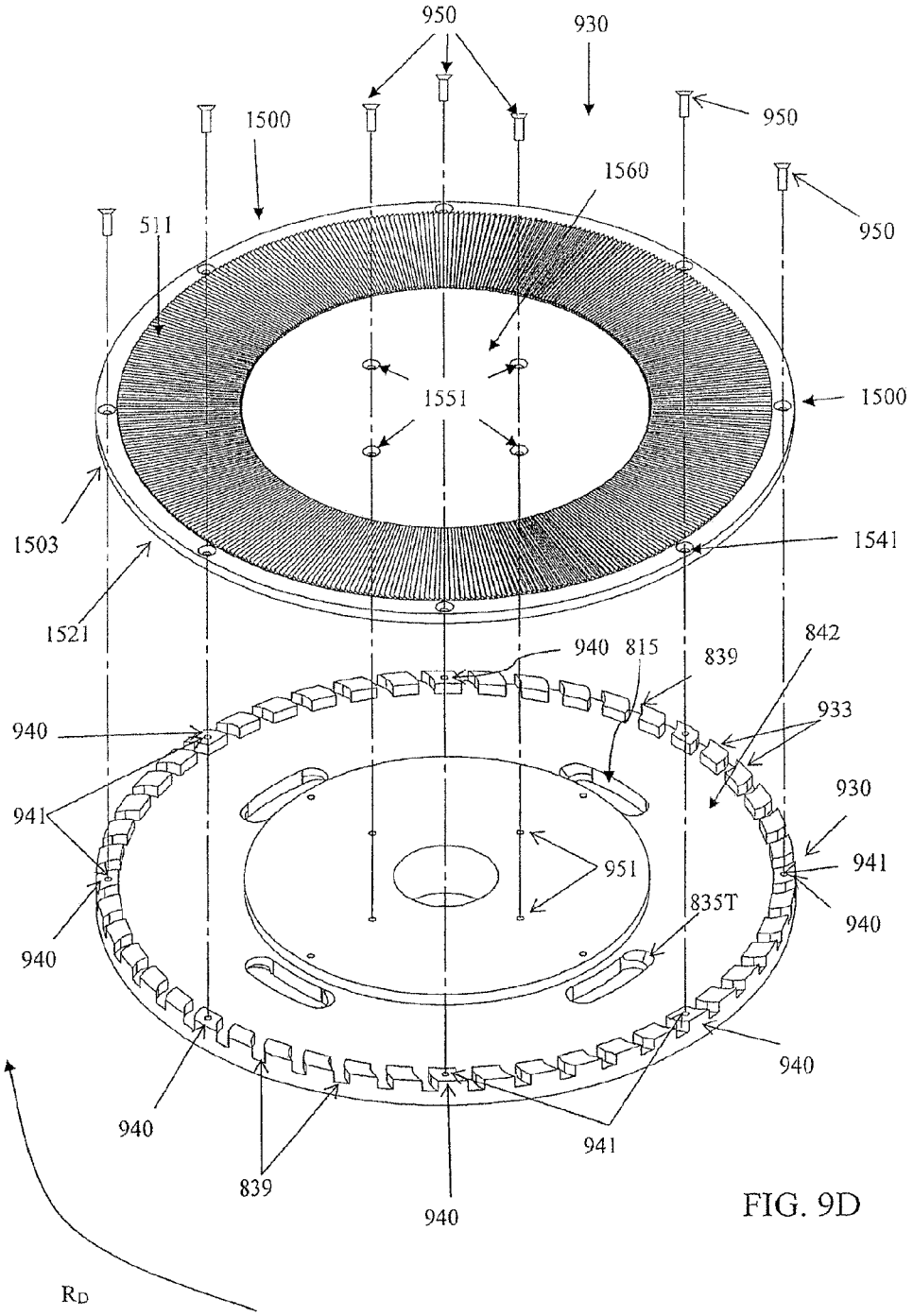
FIG. 9D illustrates an exploded view of a rotating disc attached to the carrying plate according to the embodiment shown in FIGS. 9A to 9C.

As also illustrated in FIGS. 9A and 9D, the attaching mechanism 930, may, in one preferred embodiment, comprise at least one attaching rib 940 extending axially from the inside surface 842 of the carrying plate 840. The attaching ribs 940 may have attaching rib openings 941 which may receive a number of corresponding screws, rivets, or other fastening mechanisms, as shown generally by reference numeral 950, to attach the rotating disc 1500 to the carrying plate 840. In this embodiment, the attaching mechanism 930 may also comprise the radial flange 1503 for operatively attaching the rotating disc 1500 to the at least one rib 940 thereby attaching the rotating disc 1500 to the carrying plate 840 at a position axially separated from the inside surface 842 and the air inlets 835. The fastening mechanism 950 may releasably attach the disc 1500 to the carrying plate 840 to permit subsequent removal and/or replacement of the rotating disc 1500 and/or carrying plate 840. Alternatively, the rotating disc 1500 may be permanently attached to the carrying plate 840 such that the entire combination of the rotating disc 1500 and carrying plate 840 could be replaced as a unit. It is understood that this is one preferred embodiment for the attaching mechanism 930, and other embodiments may be proposed for attaching the rotating disc 1500 to the carrying plate 840. For instance, as also illustrated in FIG. 9D, openings 951 in the carrying plate 840 and corresponding openings 1551 in the rotating disc 1500 respectively, may also receive screws, rivets or other fastening mechanisms 950 in the inner portion 1560 of the rotating disc 1500. The attaching mechanism 930 could comprise both the openings 951, 1551 and fastening mechanisms 950 in the center portion 1560 of the rotating disc 1500 and/or the openings 941 in the attaching ribs 940 with corresponding openings 1541 in the radial flange 1503, or both. It is understood that the attaching mechanism 930 could take on different structures to attach the rotating disc 1500 to the carrying plate 840 at an axial position from the air inlets 835 of the carrying plate 840 to permit air flow between the carrying plate 840 and the rotating air cooling surface 1521. In a preferred embodiment, the attaching mechanism 930 encompasses both the openings 941 in the attaching ribs 940 with the corresponding openings 1541 in the radial flange 1503, as well as the openings 951 in the carrying plate 840 and the corresponding openings 1551 in the center portion 1560 of the rotating disc 1500.

In a further preferred embodiment, the attaching ribs 940 have a similar shape to the plurality of backward curved support ribs 933. In this preferred embodiment, the attaching ribs 940 and support ribs 933 may also be located at the same radial position on the carrying plate 840 and corresponding to the radial position of the radial flange 1503 when the rotating disc 1500 is attached to the carrying plate 840. In this way, the attaching ribs 940 perform a similar function to the support ribs 933, namely to form angled backward passages 839 in addition to operatively attaching the rotating disc 1500 to the carrying plate 840 with the rotating air cooling surface 1521 of the rotating disc 1500 separated from the inside surface 842 of the carrying plate 840 to assist in channelling the air therebetween. In this preferred embodiment, the support ribs 933 may be located between the attaching ribs 940. An air path according to this preferred embodiment is shown by dashed lines and identified by reference numeral 1155 in FIGS. 10A and 10B.

Figure 9E:
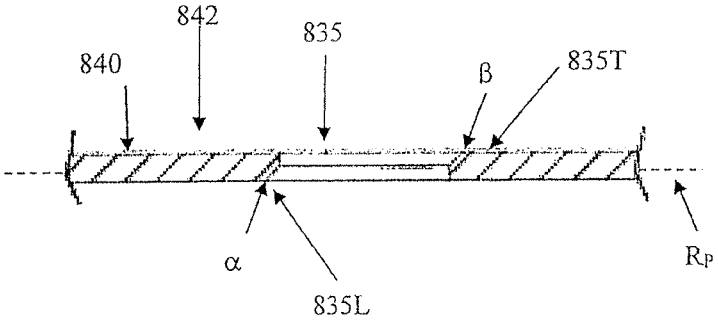
FIG. 9E illustrates an enlarged cross sectional view along section A-A of air inlet in the carrying plate shown in FIGS. 9A to 9D.
Figure 9E:
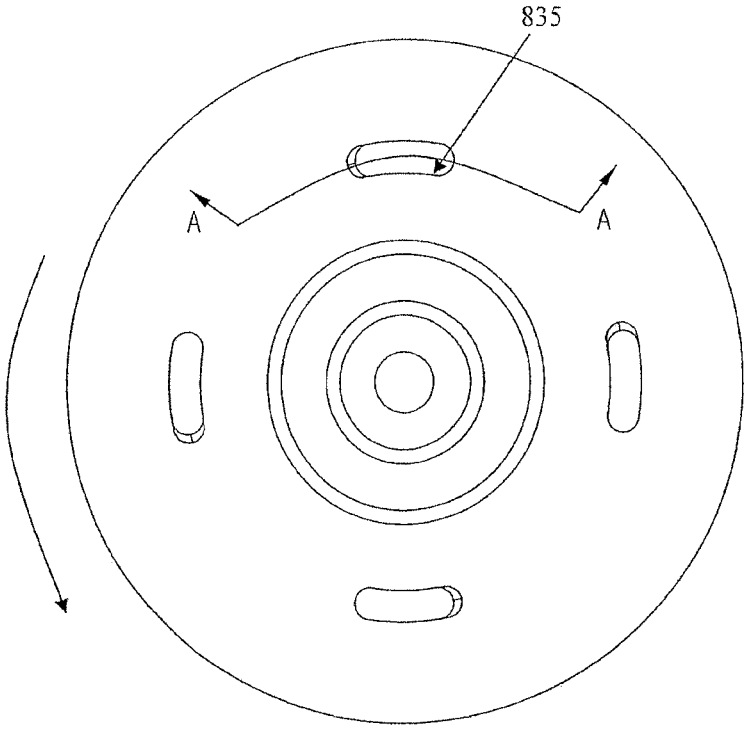

In a further preferred embodiment, the air inlets 835 of the carrying plate 840 have a leading edge 835L in the rotating direction $R_D$ which forms an angle of incidence, illustrated generally by reference symbol a of FIG. 9E, of between 30° and 70° with respect to the plane of rotation R. In a further preferred embodiment, the angle of incidence a of the leading edge 835L in the rotating direction $R_D$ is between 40° and 60° with respect to the plane of rotation R. In this way, as the carrying plate 840 rotates in the rotating direction $R_D$, the air inlets 835 engage the air in the disc mill housing 230 in a less aggressive manner and air enters the air inlets 835 more gently. This promotes air flow through the air path 1155. Similarly, the trailing edge 835T of the air inlets 835 may preferably have a corresponding angle of egress βwith respect to the plane of rotation $R_p$ which is the same as or similar to the angle of incidence α. In this way, air can enter and exit through the air inlets 835 more smoothly. This may also decrease the noise generated by the air inlets 835 in the carrying plate 840.

Figure 10A:
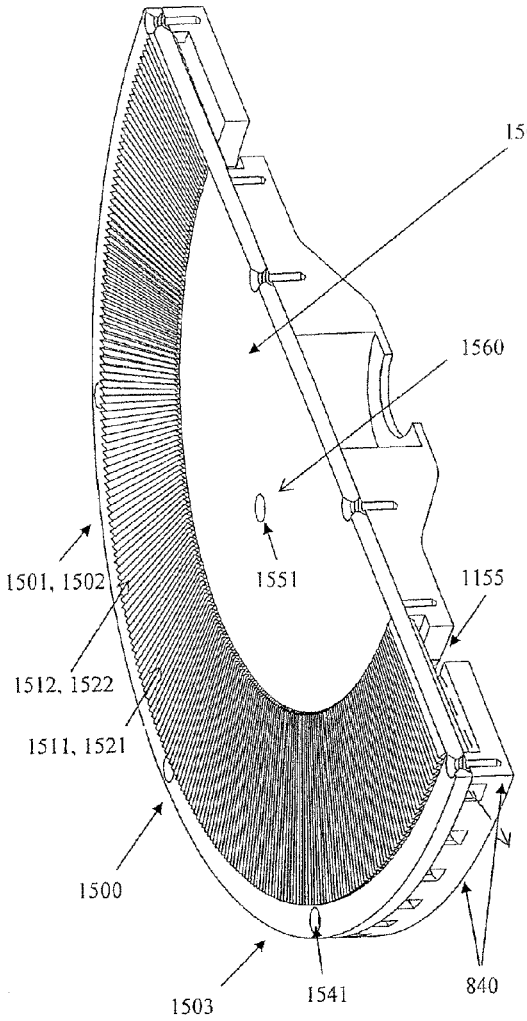
FIGS. 10A and 10B illustrate the continuous rotating disc attached to a carrying plate in one preferred embodiment in cross section, with FIG. 10A showing the internal view of the rotating disc with the stationary disc removed, and, FIG. 10B showing the external surface of the carrying plate.
Figure 10B:
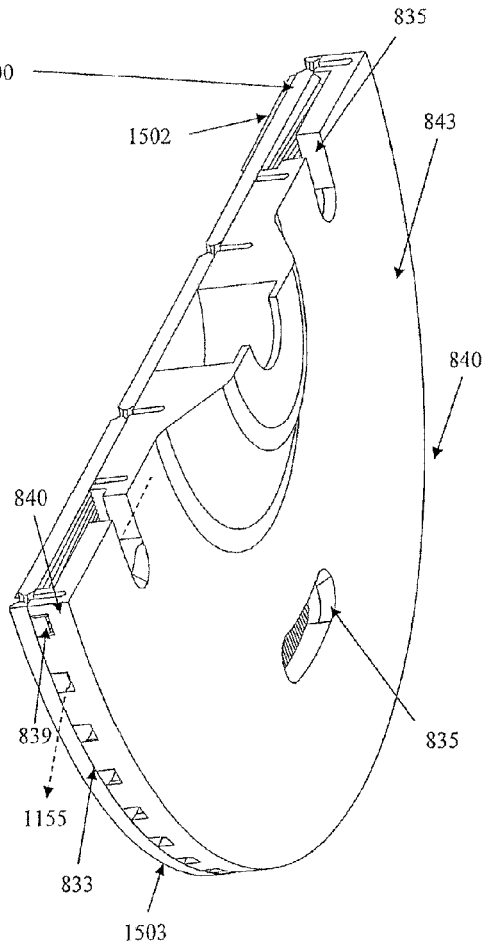

FIG. 10A illustrates the rotating disc 1500 attached to the carrying plate 840 in cross-section. FIG. 10A illustrates the first side 1501, which in this orientation operatively interacts with the stationary disc 300 (not shown in FIG. 10A). The external surface 843 of the carrying plate 840 is shown in FIG. 10B. As illustrated in FIGS. 10A and 10B, dash lines show the air flow, shown generally by reference number 1155, which passes from the air inlets 835, between the carrying plate 840 and the cooling surface 1521 of the rotating disc, and through the air passages 839 formed between the support ribs 833 and also the attaching ribs 940. The air passages 839 are located radially distant from the air inlets 835 to channel the air radially outwardly from the air inlets 835 and between the carrying plate 840 and the rotating cooling surface 1521.

Figure 11A:
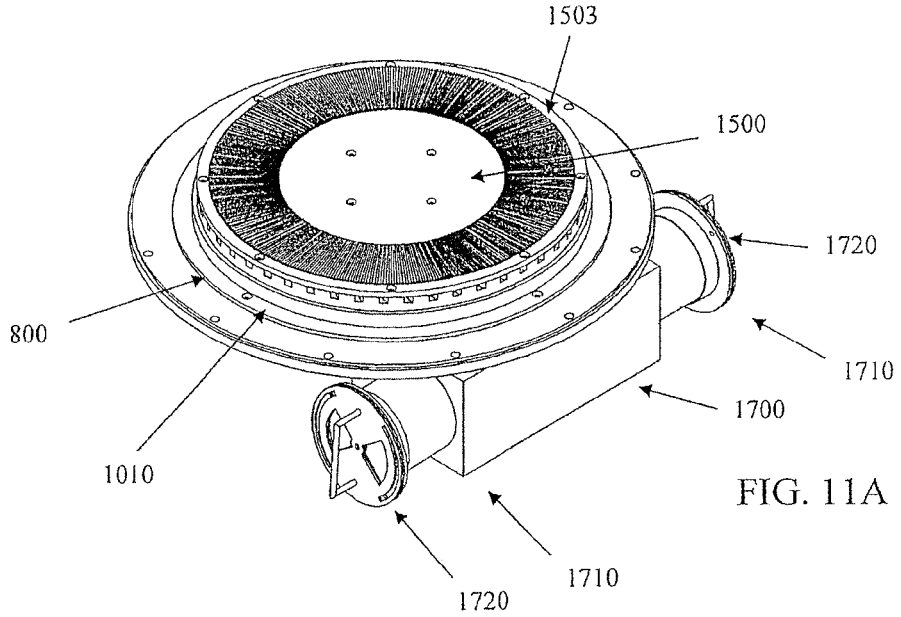
FIGS. 11A and 11B illustrates the disc mill assembly of FIG. 8 with the stationary disc removed and FIG. 11B shows a quarter cross section cut out of FIG. 11A.
Figure 11B:
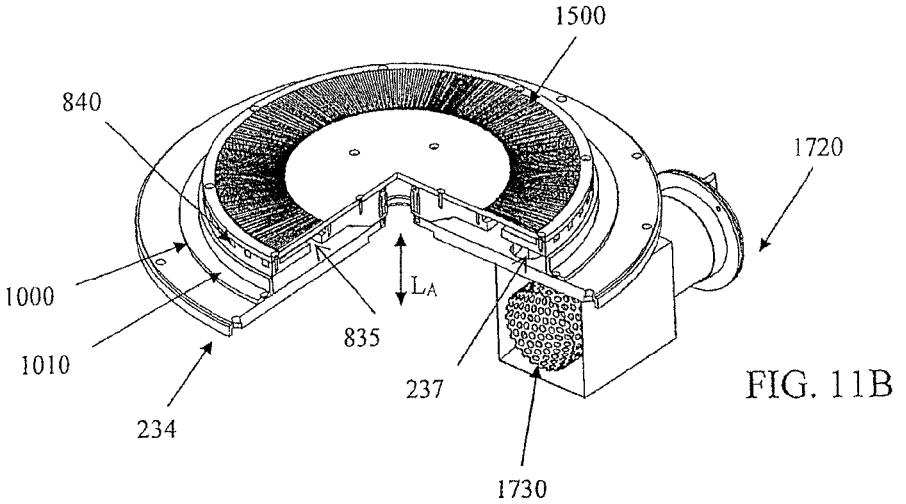
Figure 12:
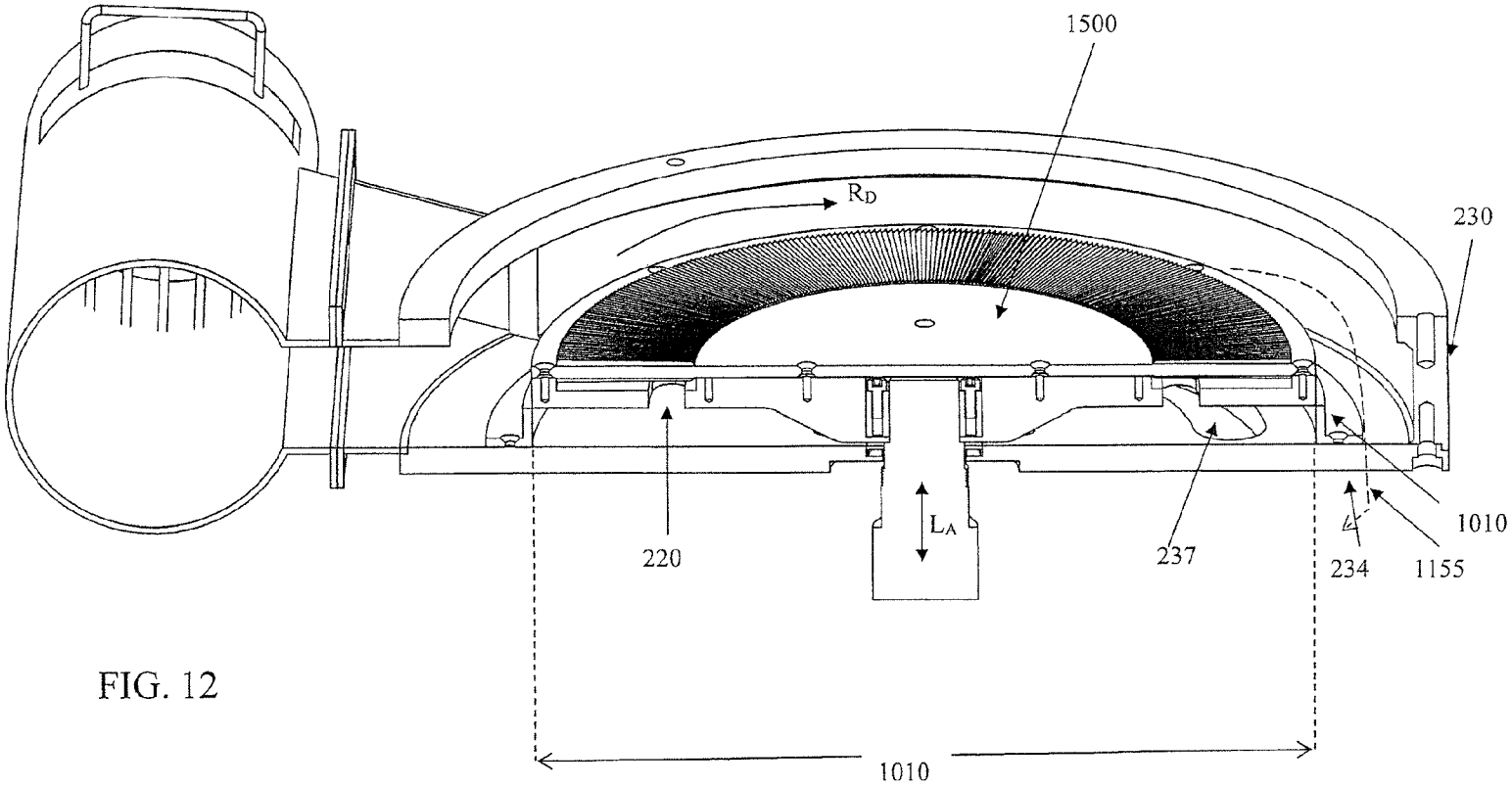
FIG. 12 illustrates the rotating disc attached to the carrying plate and installed in an air baffle member.

FIGS. 11A and 11B show the disc mill assembly 800 with the stationary disc 300 removed. As illustrated in FIG. 11A, and in FIG. 11B, which is a quarter cross section cut out of FIG. 11A, in the preferred embodiment there is a muffler 1730 through which air passes from sliding air vents 1720 at the air intake 1710. The muffler 1730 may also assist in decreasing the noise generated by the carrying plate 840 and rotating disc 1500. The sliding air vents 1720 assist in controlling air flow passing through the inlets 237 in the housing body 234. As also illustrated in FIGS. 11A and 11B, the baffle member 1000 is preferably the baffle ring 1010 as also illustrated in FIG. 8. Furthermore, in this preferred embodiment, the inner diameter $ID_{BR}$ of the baffle ring 1010 is not greater than the outer diameter $OD_{CP}$ of the carrying plate 840 to facilitate directing air flow 1155 through the lower inlets 237 towards the rotating inlets 835 while the carrying plate 840 is rotating and decrease air spillage into the mill housing 230 without passing though air inlets 835. This is illustrated in FIG. 12 which shows a cross section of the disc 1500 and carrying plate 840 within the mill housing 230. FIG. 12 also illustrates that the outer diameter $OD_{CP}$ of the carrying plate 840 is substantially the same as the inner diameter $ID_{BR}$ of the air baffle ring 1010. Preferably, the air baffle ring 1010 is sufficiently large to encompass the lower air inlets 237, but not larger than the outer diameter $OD_{CP}$ of the carrying plate 840 so as to decrease leakage of air into the mill housing 230 from the lower air inlets 237 without entering the rotating air inlets 835. This also assists in preventing reduced material 11 from entering the lower air inlets 237 and possibly engaging the muffler 1730 or other components of the air restricting device 1700. This baffle ring 1010 also deters warmed air exiting from between the discs 300, 1500 from entering the air inlets 835, and, rather channels cooler air from the lower air inlets 237 to enter the air inlets 835. In addition to cooling the rotating disc 1500, the baffle ring 1010 improves air flow from the lower air inlets 237 and avoids re-circulation of heated air in the disc assembly 800, thereby permitting cooler air to circulate in the disc mill assembly 800 and cool air to exit from near the discs 300, 1500. This is particularly the case where the stationary disc 300 is also air cooled as discussed above. By cooling the discs 300, 1500, and having cooler air exiting air passage 239, 839, the disc mill assembly 800, and the pulverized material 11 is also cooled, thereby decreasing melting and/or agglomeration of hot pulverized material 11. Also, the cooler air exiting from the air passage 839 facilitates cooling of the reduced material 11 exiting between the discs 300, 1500. Similarly, the cooler air from the stationary air inlets 235 which exit from the stationary air passage 239 also facilitates cooling of the reduced material 11. Preferably, the air passages 239, 839 are near an exit of the reduced material 11 from between the stationary disc 300 and the rotating disc 1500 to facilitate cooling of the reduced material 11 as soon as it exits from between the discs 300, 1500 and while still in the disc chamber 220. The reduced material 11 then becomes entrained in the air exiting from the air passages 239, 839, as well as the air circulating in the disc chamber 220 for removal therefrom. Thus, by more efficiently cooling the discs 300, 1500, and the disc mill assembly 800 as a whole, material 10 having a lower melting temperature, such as nylon and polypropylene, could be more easily reduced, where before, there would be a greater concern of melting and/or agglomeration of such material.

FIGS. 13A, 13B, 13C, and 13D illustrate a preferred embodiment of the rotating disc 1500. In this preferred embodiment, the rotating disc 1500 is continuous, meaning that there is no opening or orifice in the center, but rather there is a center portion 1560 as also discussed above. This is a preferred embodiment as it is understood that the rotating disc 1500 could also operate with an orifice in place of the center portion 1560. In fact, as discussed below, in one preferred embodiment the rotating disc 1500 may have the same shape as the stationary disc 300, such that only one type of disc 300, 1500 would need to be shipped and stored and operate as both the rotating and stationary discs 300, 1500.

Returning to the continuous rotating disc 1500 illustrated in FIGS. 13A, 13B, 13C and 13D, it is appreciated that this rotating disc 1500 is symmetrical about the continuous rotating disc radial plane, shown generally the dash lines in FIGS. 13A and 13B and identified generally by the reference numeral $CR_{RP}$. However, it is understood that the invention encompasses other embodiments where the rotating disc 1500 is not symmetrical about the continuous rotating disc radial plane $CR_{RP}$. In such cases, where the rotating disc 1500 is not symmetrical, additional centrifugal forces may be created during rotation which would need to be counteracted by another member, and possibly by the carrying plate 840.

As illustrated in FIG. 13A, the first side 1501 of the rotating disc 1500 preferably comprises a first cutting surface 1511. The first cutting surface 1511 preferably comprises a plurality of substantially radially extending edges 1512. When the rotating cutting surface 1511 is in operative interaction with the stationary disc 300, the stationary disc 300 and rotating disc 1500 reduce the raw material 10 to the reduced material 11. It is understood that this is also similar to the process referred to above with respect to the rotating disc 500 in the embodiment illustrated by the disc mill 200.

FIG. 13C illustrates the second side 1502 of the rotating disc 1500. It is understood that when the first side 1501 is in operative interaction with the stationary disc 300, the second side 1502 will be used to interact with the air passing between the rotating disc 1500 and the carrying plate 840 to cool the rotating disc 1500 in the disc mill assembly 800. Thus, the second side 1502 of the rotating disc 1500 comprises a rotating air cooling surface 1521, such that when the rotating air cooling surface 1521 faces the air inlets 835 of the carrying plate 840, and is axially separated therefrom along the longitudinal axis $L_A$, air is permitted to flow between the carrying plate 840 and the rotating air cooling surface 1521, such that heat generated by the first cutting surface 1511 is dissipated by the rotating air cooling surface 1521. To facilitate this, the rotating air cooling surface 1521 preferably has a surface which can facilitate dissipation of heat into the air flow 1155. For instance, preferably, the rotating air cooling surface 1521 has fins or cooling ridges 1523 which preferably extend in a radial direction to permit the air flow 1155 to come into contact with a larger surface area, such as in excess of 100%, compared to a flat surface. In this way, the rotating air cooling surface 1521 dissipates heat generated by the disc mill assembly 800 to the air flow 1155, more efficiently.

Accordingly, in one preferred embodiment, the rotating air cooling surface 1521 acts as a heat sink as air flow 1155 entering through the air inlets 835 passes between the carrying plate 840 and the rotating air cooling surface 1521. In a preferred embodiment, the rotating air cooling surface 1521 comprises a plurality of radially extending cooling ridges 1523 which facilitates cooling of the rotating disc 1500. Similarly, the cutting surface 1511 on the first side 1501 has cutting edges 1512 which, when the rotating disc 1500 is attached to the carrying plate 840 in a first orientation, are arranged in facing operative interaction with the stationary cutting surface 311 of the opposed stationary disc 300 to reduce the input material 10.

Preferably, the rotating air cooling surface 1521 is in thermal contact with the rotating cutting surface 1511. This can be accomplished, for instance, by having a material, generally a metal that is a relatively good thermal conductor in thermal contact with rotating cutting surface 1511 and the rotating air cooling surface 1521 to conduct heat generated by the rotating cutting surface 1511 to the rotating cooling surface 1521. In the further preferred embodiment, the rotating cooling surface 1500 is made of a continuous metal or metal alloy which has both relatively good thermal conducting characteristics to transfer or conduct heat, but also has the required degree of strength to perform the cutting action.

In a further preferred embodiment, the continuous rotating disc 1500 is substantially symmetrical about the continuous rotating radial plane $CR_{RP}$, with the plurality of ridges 1523 on the air cooling surface 1521 also comprises cutting edges 1522. In this preferred embodiment, the rotating cutting surface 1511 has cutting edges 1512, which are themselves oriented on a second plurality of radially extending cooling ridges 1513. In this way, the rotating disc 1500 can be attached to the carrying plate 840 in a second orientation with the first side 1501 facing the carrying plate 840 and the second side 1502 facing the stationary disc 300 to reduce input material 10. In this further preferred embodiment, as illustrated in FIGS. 13A, 13B and 13C, where the rotating disc 1500 is substantially symmetrical about the continuous rotating radial plane $CR_{RP}$, either the first side 1501 or the second side 1502 can be facing towards the stationary disc 300. Similarly, both the first side 1501 and the second side 1502 of the continuous rotating disc 1500 comprise a plurality of ridges 1513, 1523, which preferably are radially extending in the direction of the air flow 1155, such that either plurality of ridges 1513, 1523 can be oriented to face the air inlets 835 of the carrying plate 840, where air is permitted to flow, and thus either sides 1501, 1502 can comprise a cooling surface 1521. This is similar to the stationary disc 300 being attached in a first or second orientation.

Accordingly, in this preferred embodiment, in the second orientation, the plurality of cooling ridges 1523 have cutting edges 1522 which are arranged in facing operative interaction with the stationary cutting surface 311 of the opposed stationary disc 300 to reduce material 10. Similarly, the plurality of ridges 1513 of the first side 1501 face the carrying plate 840 and the air inlet 835 in the second orientation, such that air drawn through the air inlets 835 of the carrying plate 840 cross or pass over the plurality of ridges 1513 of the first side 1501, such that the first side 1501 then comprises rotating cooling surface 1521 to cool the rotating disc 1500 in the second orientation. Thus, the rotating disc 1500 can be re-oriented from the first orientation to the second orientation when the cutting edges 1512 of the rotating cutting surface 1511 become dull.

As indicated in FIGS. 13A, 13B, 13C and 13D the continuous rotating disc 1500 also has the center portion 1560. It has been found that occasionally cracks may form as a result of a centre orifice. Such cracks may form either along the centre orifice, or, along the center openings 1551, as a result of increased stresses caused by the centre orifice. Thus, the center portion 1560 is present in a preferred embodiment to improve the safety characteristics of the disc 1500, as having the center portion 1560 rather than an orifice decreases the channels that cracks will form due to stress and repeated fatigue and/or that crack propagation will be identified before it leads to a catastrophic failure.

Nevertheless, the rotating disc 1500 with an orifice could still operate and in this case would have a shape and function similar to the stationary disc 300. As such, as also indicated above, a single type of disc 300 could be used for both the rotating and stationary disc 300. This could decrease the cost of manufacture, shipping and inventory because only a single type of disc 300 would be required.

Figure 13E:
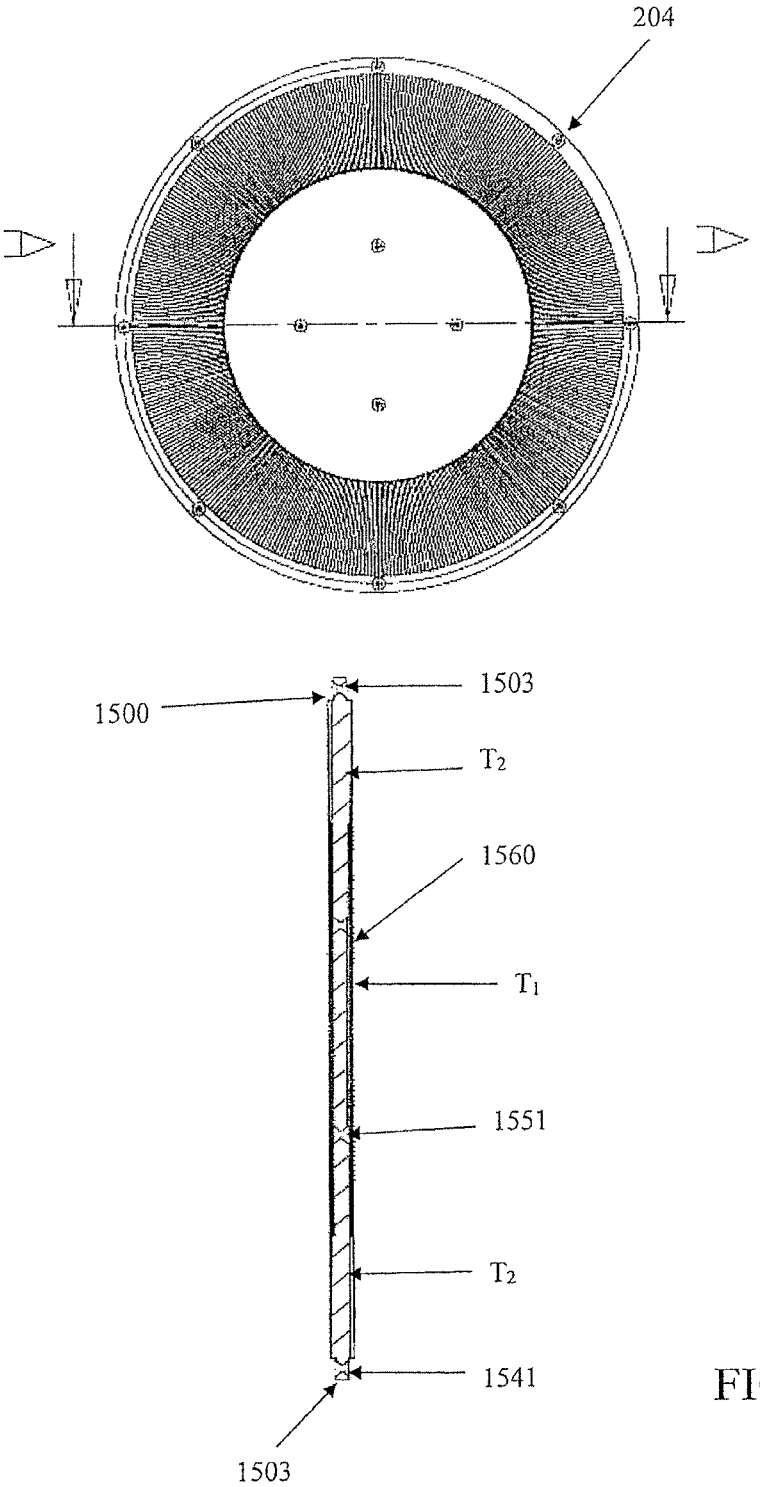

However, when a continuous rotating disc 1500 is used, it is preferred that the solid or continuous center portion 1560 supports the annular rotating cutting surface 1511 for operative interaction with the cutting surface 311 of the opposed stationary disc 300. The center portion 1560 extends radially inwardly from the annular rotating cutting surface 1511 for supporting the annular rotating cutting surface 1511. It is also preferred if the solid center portion 1560 has a first thickness $T_1$ which is less than the thickness $T_2$ of the rotating cutting surface 1511 as shown in FIG. 13E. In this way, the cost of manufacture and also the weight of the rotating disc 1500 could be lessened. Moreover, the effect on the stress of the rotating disc is less than having the center portion 1560 even if the thickness $T_1$ of the center portion 1560 is less than the thickness $T_2$ of the cutting surface 1511.

As illustrated in FIGS. 13A, 13C and 13D, the continuous rotating disc 1500 will also have the openings 1541 on the radial flange 1503 for attaching to the ribs 940 constituting a radial attaching mechanism 931. The rotating disc 1500 will also have the corresponding openings 1551 in the center portion 1560 for attaching to the corresponding openings 951 in the center of the carrying plate 840 constituting an inner attaching mechanism 932 located radially within the rotating cutting surface 1511. In this way, the attaching mechanism 930 may comprise both, or one of, the radial attaching mechanism 931 and the center attaching mechanism 932.

Accordingly, as indicated above, the rotating disc 1500, whether it has a center portion 1560 or a center orifice, can be attached. The rotating disc 1500 is preferably symmetrical about the continuous rotating disc radial plane $CR_{RP}$ and also symmetrical about the plane of rotation of the continuous rotating disc $P_{CRP}$. As with the stationary disc 300, the rotating disc 1500 can preferably be attached to the carrying plate 840 in a first orientation or a second orientation, such that both sides of the substantially symmetrical disc 1500 can be used alternatively for cutting action and for cooling. The rotating disc 1500 has a cutting surface 1511 on the first side 1501, in the first orientation, for operative interaction with the stationary cutting surface 311, and, a second side 1502 having the rotating air cooling surface 1521 in thermal contact with the rotating cutting surface 1511, attached to the carrying plate 840 to permit in the mill housing 230 to engage the air inlets 835 and passes between the inside surface 842 of the carrying plate 840 and the cooling surface 1521 of the rotating disc 1500. The attaching mechanism 930 preferably operatively attaches the rotating disc 1500 to the carrying plate 840 and the rotating air cooling surface 1521. During operation, the carrying plate 840 and rotating disc 1500 rotate and air entering through the air inlets 835 pass between the carrying plate 840 and rotating air cooling surface 1521 to cool the rotating disc 1500.

It is understood that as discusses above, in a preferred embodiment the stationary disc 300 is also air cooled. It is understood that the air cooled stationary disc 300 and air cooled rotating disc 1500 of the present invention can operate together in the same mill assembly, as illustrated in FIG. 8 by mill assembly 800, or, can operate separately, as illustrated in the mill assembly 200 shown in FIG. 2 where only the stationary disc 300 is air cooled. While not shown, it is understood that the rotating disc 1500 having the air cooling surface 1521 facing the air inlets 835 and axially separated therefrom could be used with different types of stationary discs (not shown) and not necessarily an air cool stationary disc 300, as illustrated above. It is understood that the stationary radial flange 303 of the stationary disc 300 is shown as being substantially circumferential and extending radially a constant length along the entire stationary disc 300 from the cutting surface 311 and air cooling surface 321. It is understood, however, that the stationary radial flange 303 can have any other type of shape and it needs not be restricted to circular. For instance, the stationary radial flange 303 could have individual projections to engage the housing lid 232 in order to permit the attaching mechanism 430 to releasably attach a stationary disc 300 to the housing lid 232. For instance, the radial flange 303 could consist of a plurality of individual radial protrusions which engage the ribs 440. It is preferred, however, to have the radial flange 303 may extend radially along most of the circumference of the stationary disc 300 so that the stationary disc 300 can be supported by the ribs 233 on the inner surface 242 of the housing lid 232. Similarly, the rotational radial flange 1503 of the rotating disc 1500 (whether the disc 1500 is continuous or has an orifice) need not extend radially a constant length along the entire circumference of the rotating disc 1500 so that the rotational radial flange 1503 may have other shapes which can attach the flange 1503 to the attaching ribs 940.

It is also understood that the housing lid 232 is part of the housing 230 to house the mill assembly 200. As indicated above, reference to housing lid 232 is understood to be a portion of the overall housing 200 and therefore it could be referred to as the housing 230 of the mill assembly 200. Also, the portion of the housing 230 to which the stationary disc 300 is attached, need not necessarily be the top portion, but rather the housing lid 232 may be any portion of the housing 230 to which the stationary disc 300 is attached. Similarly, the rotating disc 500 or 1500 need not be on the lower portion. Furthermore, the lower air inlets 237 need not be lower than the stationary air inlets 235. Rather, the disc mills 200, 800 may have any orientation with either of the discs 300, 500 being on top, and indeed, the discs 300, 500, 1500 may have other orientations, such as vertical.

To the extent that a patentee may act as its own lexicographer under applicable law, it is hereby further directed that all words appearing in the claims section, except for the above defined words, shall take on their ordinary, plain and accustomed meanings (as generally evidenced, inter alia, by dictionaries and/or technical lexicons), and shall not be considered to be specially defined in this specification. Notwithstanding this limitation on the inference of "special definitions," the specification may be used to evidence the appropriate, ordinary, plain and accustomed meanings (as generally evidenced, inter alia, by dictionaries and/or technical lexicons), in the situation where a word or term used in the claims has more than one pre-established meaning and the specification is helpful in choosing between the alternatives.

It will be understood that, although various features of the invention have been described with respect to one or another of the embodiments of the invention, the various features and embodiments of the invention may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments, which are functional, electrical or mechanical equivalents of the specific embodiments and features that have been described and illustrated herein.

The invention claimed is:

1. A disc mill assembly of a reducing apparatus, said disc mill assembly comprising:

a stationary disc having a stationary cutting surface;

a rotating disc having a rotating cutting surface on a first side for operative interaction with the stationary cutting surface of the opposed stationary disc, and, a second side having a rotating air cooling surface in thermal contact with the rotating cutting surface;

a carrying plate having air inlets;

an attaching mechanism for operatively attaching the rotating disc to the carrying plate with the rotating air cooling surface facing the air inlets and axially separated therefrom to permit air flow between said carrying plate and the rotating air cooling surface;

wherein, during operation, the carrying plate and rotating disc rotate, and, air enters through the air inlets and passes between the carrying plate and the rotating air cooling surface, to cool the rotating disc.

2. The disc mill assembly as defined in claim 1 further comprising a plurality of air passages located between the rotating disc and the carrying plate for channelling air from the air inlets, between the rotating air cooling surface and the carrying plate, and through the plurality of air passages.

3. This disc mill assembly as defined in claim 2 wherein the plurality of air passages channel air having passed from between the carrying plate and rotating disc to cool reduced material exiting from between the stationary disc and rotating disc.

4. The disc mill assembly as defined in claim 2 further comprising a plurality of support ribs extending axially from an inside surface of the carrying plate to axially separate the rotating air cooling surface of the rotating disc from the inside surface of the carrying plate, said plurality of support ribs forming said plurality of air passages therebetween.

5. The disc mill assembly as defined in claim 4 wherein the plurality of support ribs are backward curved from a direction of rotation of the carrying plate.

6. The disc mill assembly as defined in claim 1 wherein the attaching mechanism comprises a radial flange located radially beyond the rotating air cooling surface of the rotating disc for operatively attaching the rotating disc to at least one attaching rib extending axially from an inside surface of the carrying plate to axially separate the rotating air cooling surface of the rotating disc from the inside surface of the carrying plate forming an air channel from the air inlets between the carrying plate and the rotating cooling surface, and over the radial flange.

7. The disc mill assembly as defined in claim 6 wherein the attaching mechanism comprising a plurality of backward curved support ribs for supporting the radial flange of the rotating disc and directing air flow through a plurality of air passages defined by the radial flange, the supporting ribs and the inside surface of the carrying plate, said plurality of backward curved support ribs located radially distant from the air inlets to channel air flow radially outwardly between the carrying plate and the rotating air cooling surface.

8. The disc mill assembly as defined in claim 7 wherein the at least one attaching rib has a similar shape to the plurality of backward curved support ribs.

9. The disc mill assembly as recited in claim 1 wherein the rotating air cooling surface comprises a plurality of substantially radially extending cooling ridges having cutting edges and the rotating cutting surface comprising a plurality of substantially radially extending cutting ridges having cutting edges;

wherein the attaching mechanism operatively attaches the rotating disc to the carrying plate in a first orientation, with the rotating air cooling surface facing the air inlets and axially separated therefrom to permit air to flow between said carrying plate and said cooling surface, and, with said plurality of substantially radially extending cutting ridges of the rotating cutting surface arranged in facing operative interaction with the stationary cutting surface of the opposed stationary disc to reduce the input material, and wherein the attaching mechanism operatively attaches the rotating disc to the carrying plate in a second orientation, with said plurality of substantially radially extending cutting ridges of the rotating cutting surface facing the air inlets and axially separated there from to permit air to flow between said carrying plate and said cutting surface, and, with said plurality of cooling ridges of the air cooling surface having cutting edges arranged in facing operative interaction with the stationary cutting surface of the opposed rotating disc to reduce the input material, and wherein, in the second orientation, during operation, air is drawn through the air inlets of the carrying plate and between the carrying plate and the plurality of cutting ridges of the rotating cutting surface to cool the rotating disc.

10. The disc mill assembly as defined in claim 1 wherein, the rotating disc is substantially symmetrical about a central radial plane and the central radial plane substantially coincides with a plane of rotation of the rotating disc.

11. The disc mill assembly as defined in claim 1 wherein the carrying plate is rotated about a plane of rotation in a rotating direction, and the air inlets of the carrying plate have a leading edge in the rotating direction which form an angle of incidence of between 30° and 70° with respect to the plane of rotation.

12. The disc mill assembly as defined in claim 11 wherein the angle of incidence of the leading edge in the rotating direction is between 40° and 60° with respect to the plane of rotation.

13. The disc mill assembly as defined in claim 1 further comprising an intake for air from the disc mill and a muffler located near the intake.

14. The disc mill assembly as defined in claim 1 further comprising an air buffer member for separating the air flow to the air inlets in the carrying plate from air flow between the rotating and stationary disc.

15. The disc mill assembly as defined in claim 14 further comprising:

a housing for the stationary disc, the rotating disc and the carrying plate, said housing having air supply openings to supply air to the air inlets of the carrying plate;

wherein said air buffer member directs air from the air supply openings in the housing to the air inlets in the carrying plate and prevents entrained material from entering the air supply openings.

16. The disc mill assembly as defined in claim 15 further comprising:

an air control device for controlling air flow through the air supply openings in the housing supplying air to the air inlets of the carrying plate to control cooling of the rotating disc.

17. The disc mill assembly as defined in claim 1 wherein the rotating disc and the stationary disc are substantially identical.

18. The disc mill assembly as defined in claim 1 wherein the rotating disc comprises a solid centre portion extending radially inwardly from the rotating cutting surface.

19. The disc mill assembly as defined in claim 1 further comprising:

a housing lid having stationary air inlets on an external wall thereof;

a stationary attaching mechanism for operatively attaching the stationary disc to the housing lid;

wherein the stationary disc has a first side comprising the stationary cutting surface for operative interaction with the rotating cutting surface of the opposed rotating disc, and, a second side comprising a stationary air cooling surface in thermal contact with the stationary cutting surface;

wherein the stationary attaching mechanism operatively attaches the stationary disc to the housing lid with the stationary air cooling surface facing the stationary air inlets and axially separated therefrom to permit air flow between said housing lid and the stationary air cooling surface;

wherein, during operation, air is drawn in from the stationary air inlets, and, passes between the housing and the stationary air cooling surface, to cool the stationary disc.

20. The disc mill assembly as defined in claim 19 further comprising:

a plurality of rotating air passages located between the rotating disc and the carrying plate for channelling air from the air inlets, between the rotating cooling surface and the carrying plate, and through the plurality of rotating air passages;

a plurality of stationary air passages located between the stationary disc and the housing lid for channelling air from the stationary air inlets, between the housing lid and the stationary air cooling surface, and through the plurality of stationary air passages;

wherein the stationary air passages and the rotating air passages are located near an exit of reduced material from between the stationary disc and rotating disc to facilitate cooling of the reduced material.

* * * * *